US011857819B2

(12) United States Patent
Aronson

(10) Patent No.: US 11,857,819 B2
(45) **Date of Patent: *Jan. 2, 2024**

(54) PILATES REFORMER EXERCISE DEVICE

(71) Applicant: ROCKIT BODY LLC, Manhattan Beach, CA (US)

(72) Inventor: Judith Aronson, Studio City, CA (US)

(73) Assignee: ROCKIT BODY LLC, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/868,556

(22) Filed: Jul. 19, 2022

(65) Prior Publication Data

US 2022/0379155 A1 Dec. 1, 2022

Related U.S. Application Data

(62) Division of application No. 16/745,262, filed on Jan. 16, 2020, now Pat. No. 11,420,087.

(Continued)

(51) Int. Cl.
*A63B 21/00* (2006.01)
*A63B 21/055* (2006.01)

(Continued)

(52) U.S. Cl.
CPC .... *A63B 21/00069* (2013.01); *A63B 21/0552* (2013.01); *A63B 21/151* (2013.01);

(Continued)

(58) Field of Classification Search
CPC ..... A63B 21/00043; A63B 21/00058; A63B 21/00061; A63B 21/00065; A63B 21/00069; A63B 21/00072; A63B 21/00076; A63B 21/00181; A63B 21/02; A63B 21/023; A63B 21/04; A63B 21/0407; A63B 21/0414; A63B 21/0421; A63B 21/0428; A63B 21/0435; A63B 21/0442; A63B 21/062; A63B 21/0622; A63B 21/0624; A63B 21/0626; A63B 21/0628; A63B 21/063; A63B 21/0632; A63B 21/15; A63B 21/151; A63B 21/152;

(Continued)

(56) References Cited

U.S. PATENT DOCUMENTS 1,621,477 A 3/1927 Pilates
2,128,332 A 8/1938 Schollmeyer (Continued)

*Primary Examiner* — Gary D Urbiel Goldner
(74) *Attorney, Agent, or Firm* — LOZA & LOZA, LLP; Joseph G Swan

(57) ABSTRACT

A device for use with an exerciser device, such as a reformer, which permits adjustment of a resistance system, even when connected to a resistance source, by selectively relieving a resistance force imparted on the resistance adjustment system when changing a resistance and automatically reengaging the resistance force when exercising. A strain relief is coupled to a linkage between the resistance source and a resistance adjuster. When engaged, the strain relief selectively reduces the resistance force transmitted through the linkage to the resistance adjuster to permit movement of the resistance adjuster relative to a purchase. When disengaged the strain relief permits transmission of the resistance force through the linkage to the resistance adjuster.

11 Claims, 25 Drawing Sheets

Related U.S. Application Data

(60) Provisional application No. 62/793,174, filed on Jan. 16, 2019.

(51) Int. Cl.
*A63B 22/00* (2006.01)
*A63B 21/02* (2006.01)
*A63B 21/04* (2006.01)

(52) U.S. Cl.
CPC ..... *A63B 21/154* (2013.01); *A63B 21/4034* (2015.10); *A63B 22/0087* (2013.01); *A63B 21/023* (2013.01); *A63B 21/0428* (2013.01); *A63B 21/4035* (2015.10)

(58) Field of Classification Search
CPC . A63B 21/154; A63B 21/159; A63B 21/4027; A63B 21/4029; A63B 21/4031; A63B 21/4033; A63B 21/4034; A63B 21/4035; A63B 21/4045; A63B 22/0015; A63B 22/0017; A63B 22/0046; A63B 22/0087; A63B 22/0089; A63B 71/0054; A63B 2071/0063; A63B 2071/0072; A63B 2071/0081; A63B 2225/09; A63B 2225/093
See application file for complete search history.

(56) References Cited

U.S. PATENT DOCUMENTS 4,706,953 A 11/1987 Graham
4,809,972 A 3/1989 Rasmussen
4,811,945 A 3/1989 Disbrow
4,900,018 A 2/1990 Ish, III
5,110,122 A 5/1992 Moore
5,293,965 A 3/1994 Nagano
5,501,301 A 3/1996 Nishimura
5,607,381 A 3/1997 Endelman
5,653,670 A 8/1997 Endelman
5,827,154 A 10/1998 Gill
5,935,049 A 8/1999 Hamm
5,961,430 A 10/1999 Zuckerman
6,045,491 A 4/2000 McNergney
6,371,895 B1 4/2002 Endelman
6,471,624 B1 10/2002 Voris
6,726,608 B1 4/2004 Hsu
7,108,270 B2 9/2006 Poe
7,172,532 B2 2/2007 Baker
7,288,053 B2 10/2007 Endelman
7,384,381 B2 6/2008 Webber
7,465,261 B2 12/2008 Barnard
7,637,851 B1 12/2009 Lormil
7,803,095 B1 9/2010 Lagree
7,857,736 B2 12/2010 Merrithew
7,871,358 B2 1/2011 Graham
7,967,736 B2 6/2011 D'Silva
8,157,714 B2 4/2012 Mayr
8,500,614 B2 8/2013 Rooks
8,602,953 B2 12/2013 Jordan
8,641,585 B2 2/2014 Lagree
9,119,989 B1 9/2015 Lagree
9,227,106 B2 1/2016 Richards
9,492,702 B1 11/2016 Atwood
10,046,193 B1 8/2018 Aronson
10,272,281 B2 4/2019 Aronson
11,103,737 B2 8/2021 Aronson
11,420,087 B2 * 8/2022 Aronson ..... A63B 21/00072
2003/0119635 A1 6/2003 Arbuckle
2004/0072657 A1 4/2004 Arguilez
2005/0233875 A1 10/2005 Clarke
2006/0100069 A1 5/2006 Dibble
2006/0229167 A1 10/2006 Kram
2008/0171643 A1 7/2008 Baudhuin
2008/0248935 A1 10/2008 Solow
2009/0048078 A1 2/2009 Marcantonio
2009/0108648 A1 4/2009 Biggs
2011/0152032 A1 6/2011 Barnett
2012/0202661 A1 8/2012 Jordan
2013/0017935 A1 1/2013 Endelman
2014/0038777 A1 2/2014 Bird
2014/0087925 A1 3/2014 Dupuis
2014/0100089 A1 4/2014 Kermath
2014/0141948 A1 5/2014 Aronson
2015/0141218 A1 5/2015 Magrella
2015/0182793 A1 7/2015 Gutierrez
2017/0021216 A1 1/2017 Gutierrez
2017/0128762 A1 5/2017 De Palo
2018/0021617 A1 1/2018 Krull
2018/0207469 A1 7/2018 Aronson
2018/0318632 A1 11/2018 Graham
2019/0134451 A1 5/2019 McCall
2020/0222741 A1 * 7/2020 Aronson ..... A63B 21/00069

* cited by examiner

PILATES REFORMER EXERCISE DEVICE

CROSS-REFERENCES TO RELATED APPLICATION

This application is a divisional application of U.S. Non-Provisional application Ser. No. 16/745,262, titled "Pilates Reformer Exercise Machine," filed Jan. 16, 2020, which claims the benefit of U.S. Provisional Application Ser. No. 62/793,174, filed Jan. 16, 2019 and entitled "Pilates Reformer Exercise Machine," the contents of which are incorporated by reference herein in their entirety.

BACKGROUND

The disclosure relates generally to the field of exercise equipment in which portion of the exercise equipment is moved against a resistance force to exercise one or more muscles of the body.

SUMMARY

In one or more example embodiments a device is provided, which includes a purchase configured to be moved by application of an exerciser force, a resistance source providing a resistance force, a resistance adjuster configured to be selectively moved relative to the purchase to change a magnitude of the resistance force transmitted to the purchase; a linkage providing a connection between the resistance source and the resistance adjuster and selectively transmitting the resistance force, and a strain relief coupled to the linkage and operably positioned between the resistance source and the resistance adjuster, when engaged the strain relief selectively reduces the resistance force transmitted through the linkage to the resistance adjuster to permit movement of the resistance adjuster relative to the purchase, when disengaged the strain relief permits transmission of the resistance force through the linkage to the resistance adjuster.

In one or more optional embodiments the exerciser device may include a frame. In one or more optional embodiments, the purchase may be a pedal positioned at a distal end of a pedal arm, with the pedal arm hinged to the frame at a proximal end.

In one or more optional embodiments the resistance adjuster may have a slot with a plurality of enlarged portions and a pull pin coupled with the linkage, where the pull pin is selectively permitted to slide within the slot manually and selectively lock in position along the slot within one of the plurality of enlarged portions when released.

In one or more optional embodiments, the slot may be formed within a plate positioned on the pedal arm, the plate further includes an arced slot, a linkage bar carrying the pull pin at a first end and carrying a pin at the second end, the pin may be configured to slide within the arced slot as the pull pin is slid within the slot, the linkage being connected to the pin.

In one or more optional embodiments, the linkage may be a cable and the strain relief may be a stop fixed to the cable, the stop may bear against a portion of the frame when engaged such that the portion of the frame bears the resistance force sufficiently to permit movement of the resistance adjuster relative to the purchase.

In one or more optional embodiments, the strain relief may include a stop fixed to the linkage, with the stop being configured to bear against a portion of the frame when engaged such that the portion of the frame bears the resistance force sufficiently to permit movement of the resistance adjuster relative to the purchase.

In one or more optional embodiments, the stop may move with the travel of the linkage as the purchase is moved in a direction away from the portion of the frame.

In one or more optional embodiments, the linkage may be a cable and the portion of the frame may be a plate with an opening through which the cable travels, the opening being sized to prohibit passage of the stop therethrough, and where the stop may relieve a cable tension when engaged in a pedal side of the cable between the stop and the resistance adjuster.

DETAILED DESCRIPTION

Referring to the illustrated assemblies of FIGS. 1-29, one example embodiment of an improved exercise machine or reformer 30 is presented. The present exercise machine 30 can be used in various methods of exercise, and preferably, with Pilates-style fitness regimens. An example Pilates reformer is described in U.S. patent application Ser. No. 15/213,258, for "Pilates Exercise Machine," issued as U.S. Pat. No. 10,046,193 to Aronson, et al., which is incorporated by reference in its entirety.

A reformer is a type of exercise machine which may have a frame supporting two parallel tracks along which a wheeled carriage can travel. Springs or other resistance members can be used to a resiliently bias the carriage towards one end of the frame. A user typically sits or lies on the carriage and pushes against a foot bar to move the carriage away from the foot bar. Alternatively, the user can grasp the ends of a pair of ropes or straps that pass through pulleys on the frame and are attached to the carriage to move the carriage along the tracks.

Existing reformers present issues with changing resistance levels, changing the machine configuration to accommodate differing exercises, adjusting the absolute rope lengths and the lengths of ropes relative to one another, and so on. One or more benefits are provided herein (potentially including other aspects and/or benefits not listed here), is an exercise machine that is easy to use, by providing mechanisms that allow the user to easily change the machine's configuration and make adjustments as the user moves seamlessly from one exercise to another.

Figure 1:
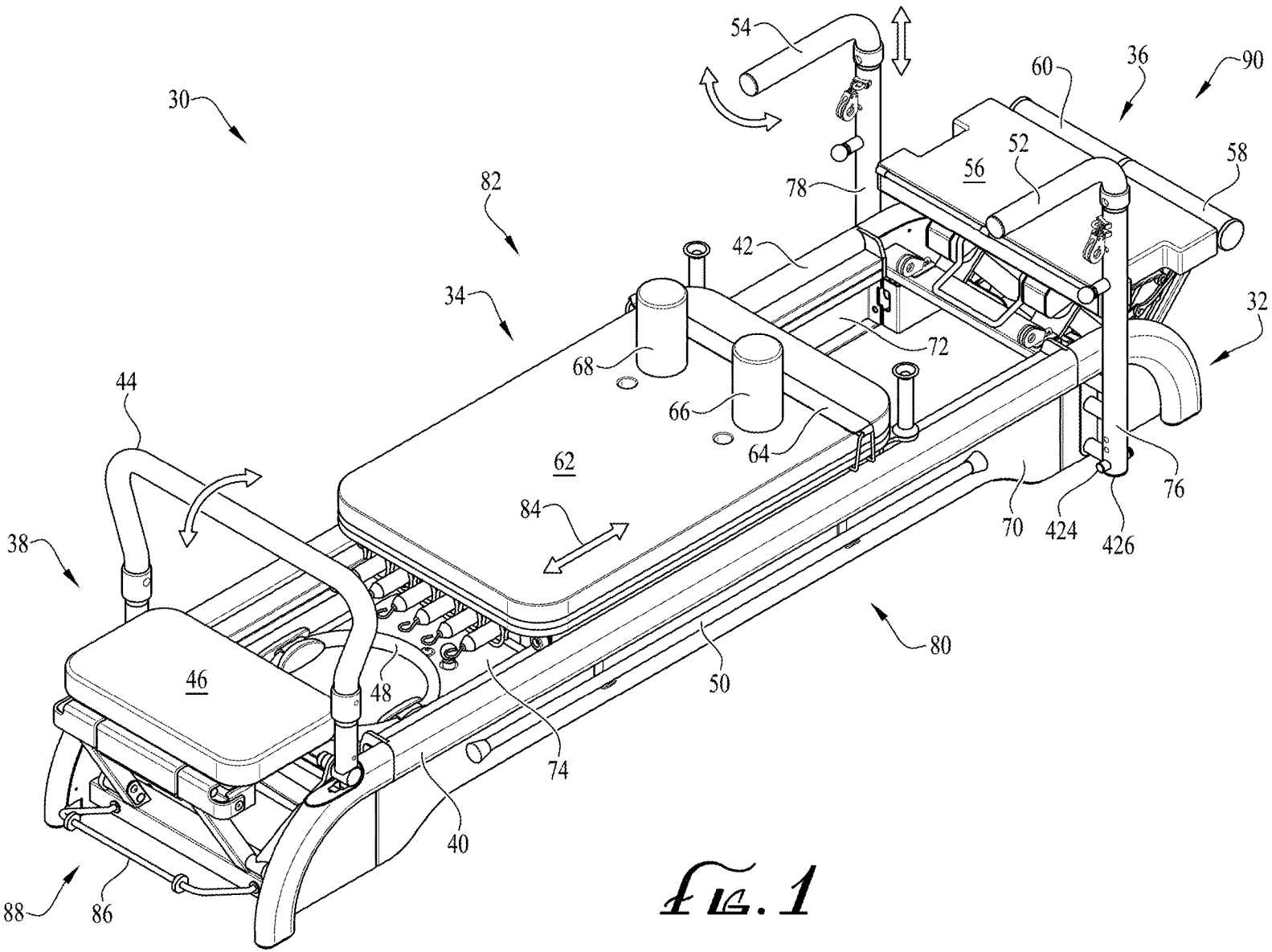
FIG. 1 is a top-front perspective view of the present exercise device.
Figure 2:
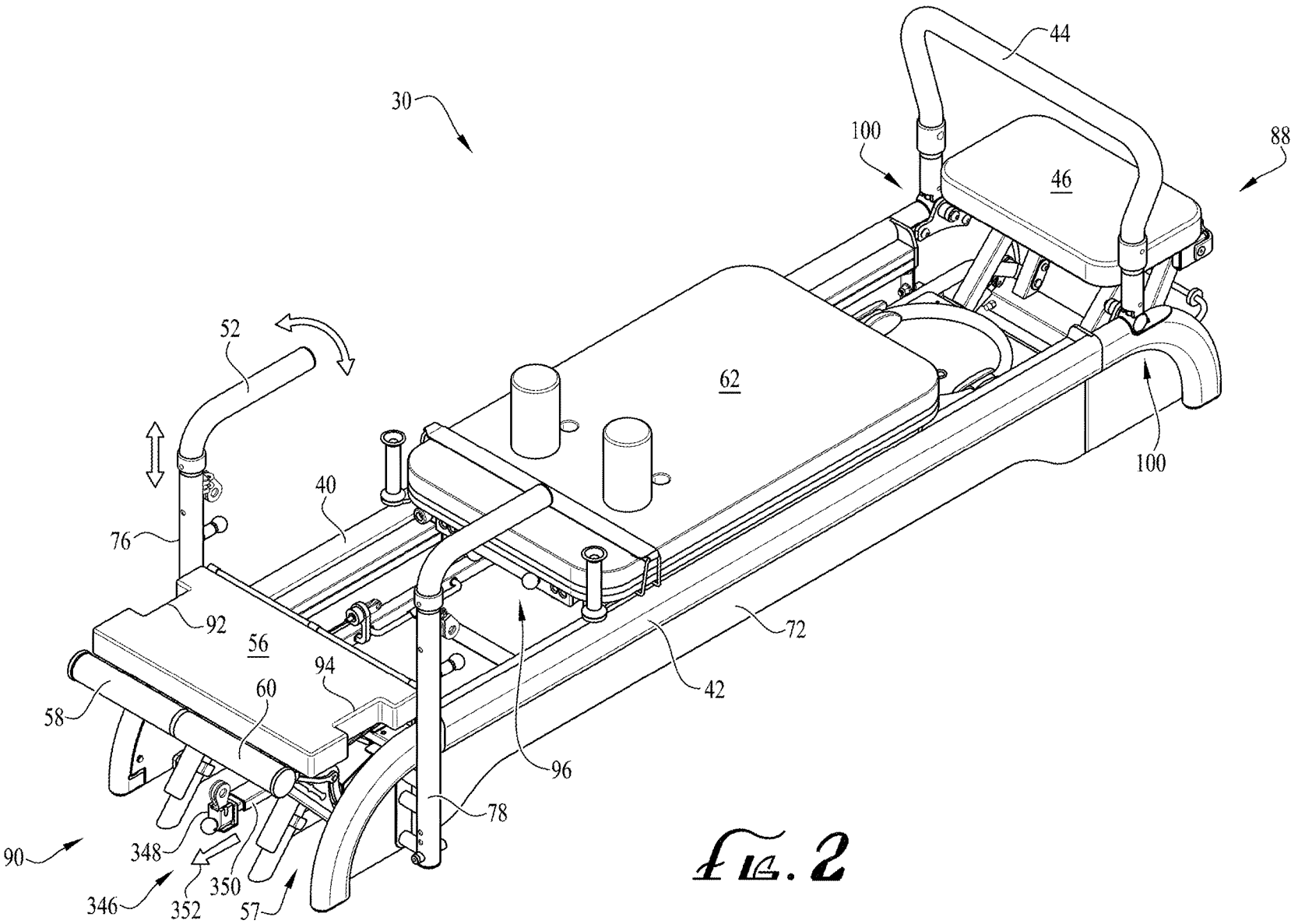
FIG. 2 is a top-back perspective view of the present exercise device.
Figure 3:
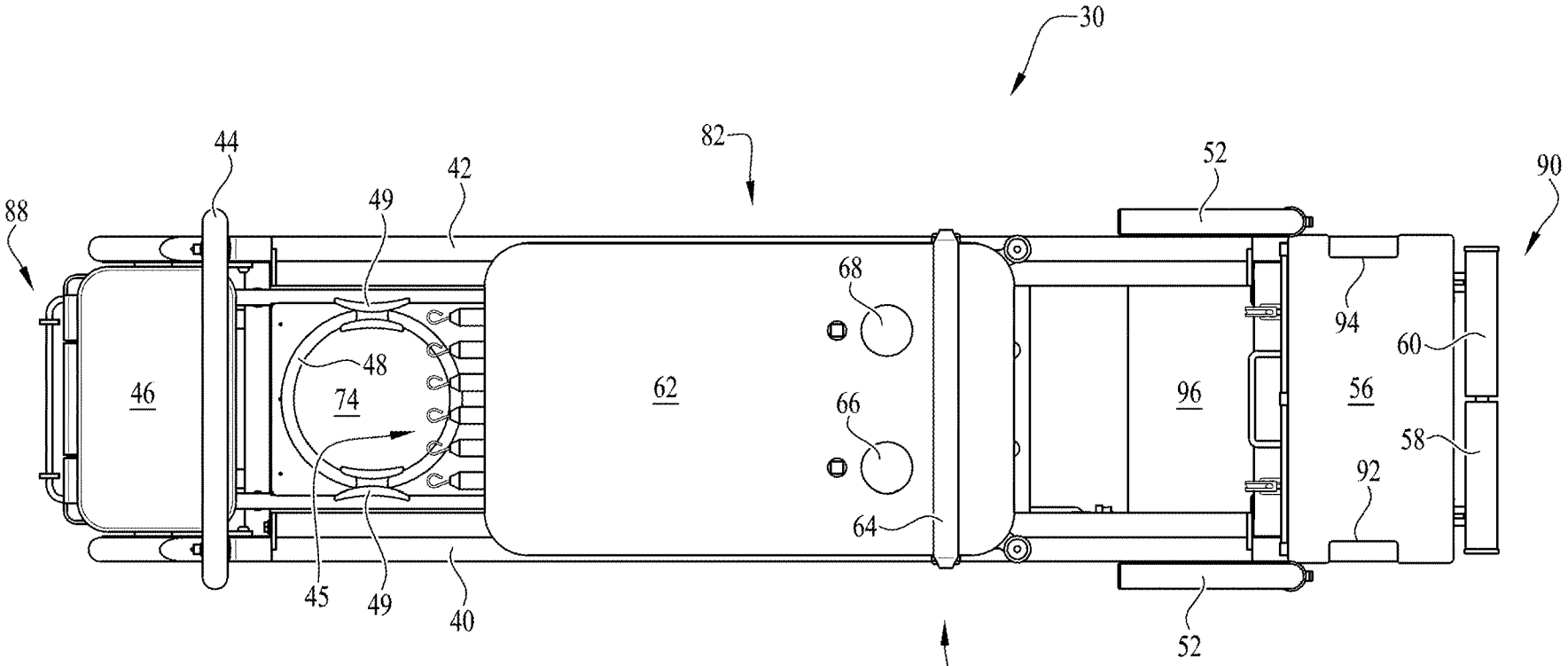
FIG. 3 is a top view of the of the present exercise device.

Looking at FIGS. 1-3, an example embodiment of the present exercise machine 30 generally includes a frame assembly 32 including rails 40, 42, a translating carriage 62, which rolls longitudinally atop the rails 40, 42 between the front end 88 and back end 90 of the exercise machine 90. Near the front end 88 is a front platform 46 and a foot bar 44 which can be tilted about the frame assembly 32. Near the back end 90 is a height adjustable seat 56 and foot pedals 58, 60. Also, near the back end 90 is a pair of handle bars 52, 54 (which can also be used as foot bars in at least one configuration), supported respectively by vertical handle bar posts 76, 78.

FIG. 1 illustrates the seat 56 in the lowered configuration, where the seat 56 is substantially level with the translating carriage 62 and the front platform 46 (e.g., less than 1" or less than 0.5" in height difference). One portion of the user's body may be supported on the translating carriage 62, while another portion of the body may be supported by either the front platform 46, when closed, or the seat 56, while in the lowered configuration.

Normally, the translating platform/carriage 62 is permitted to freely roll along the rails 40, 42, (as indicated by arrow 84), but may be selectively connected by one or more resistance springs 45 to the frame assembly 32. The resistance springs 45 resistively connect the translating carriage 62 to the frame assembly 32, so that the translating carriage 62 is spring-biased towards the front end 88. The user must overcome the spring bias in order to move the translating carriage 62 towards the back end 90. The resistance level may be adjusted by connecting a chosen number of resistance springs 45 or a specific resistance spring 45 to the frame assembly 32. The translating carriage 62 generally includes two shoulder rests 62, 68, as well as a strap extending across the top of the translating carriage 62, which may be used to hold the user's feet while exercising or for other purposes.

The foot bar 44 is generally U-shaped, with a straight horizontal section and two vertical sections which each connect to the frame assembly 32 through tilt adjustment mechanisms 100. The straight horizontal section is preferably encased in a grip material, such as foam rubber or other cushioning and gripping material. The angle or tilt of the foot bar 44 may be adjusted relative to vertical. For example, in a first position, the foot bar 44 may extend vertically, as shown in FIG. 1. Additionally, the foot bar 44 may be angled towards the front end 88 or towards the back end 90. In either of the above positions, the foot bar 44 is held firmly at a selected tilt angle by the tilt adjustment mechanisms 100, such that the user may perform various exercises by contacting the foot bar 44. When desired, the foot bar 44 may be tilted to a horizontal stowed positon, extending towards the front end 88, such that the user may perform exercises not requiring the foot bar 44, as will be described in greater detail below in reference to FIGS. 7-10 and 18-20.

The present exercise machine 30 also generally includes a balance bar 50 hung beneath the rail 40. When removed, the balance bar 50 can be held in one hand with the end of the balance bar 50 (usually a rubber foot) is rested upon the floor to enable the exerciser to maintain balance during standing exercises or other precarious exercises. Seen just beneath the translating carriage 62, is the jump board assembly 74 in the stowed position, where the translating carriage can roll above the jump board assembly 74 without interference. A resistance ring 48 is removably mounted to the jump board assembly 74 by ring mounts 49. Two side skirts 70, 72 (made of metal, plastic, etc.) are mounted beneath respective rails 40, 42, to enhance looks, add rigidity, and to protect the mechanisms therebehind from damage and debris. Further, a rope length adjustment assembly 96 is secured to the underside of the translating carriage 62, for changing the length of one or more of the ropes. Beneath the height adjustable seat 56 is a foot strap mechanism 346 that includes a rotating pulley head 348 that allows the pulley to spin relative to the telescoping extension bar 350 (once the pull pin 351 is released) that extends rearwardly (as indicated by arrow 352) to permit attachment of the tensioned ankle strap and cable (not shown) to the exerciser. Further details present exercise machine 30 include two notches 92, 94 formed in the height adjustable seat 56 to permit the exerciser to gain access to the height adjustment paddle beneath the seat 56, which enables the exerciser to change the height of the seat 56. Furthermore, a pedal assembly 57 is positioned beneath the height adjustable seat 56, where either or both of the pedals 58, 60, can be pushed down against resistance when the height adjustable seat 56 is in the raised position. Additionally, a weight tray 98 is mounted to the frame assembly 32, beneath the path of the translating carriage 62, for hold various dumbbells and other exercise equipment.

Figure 4:
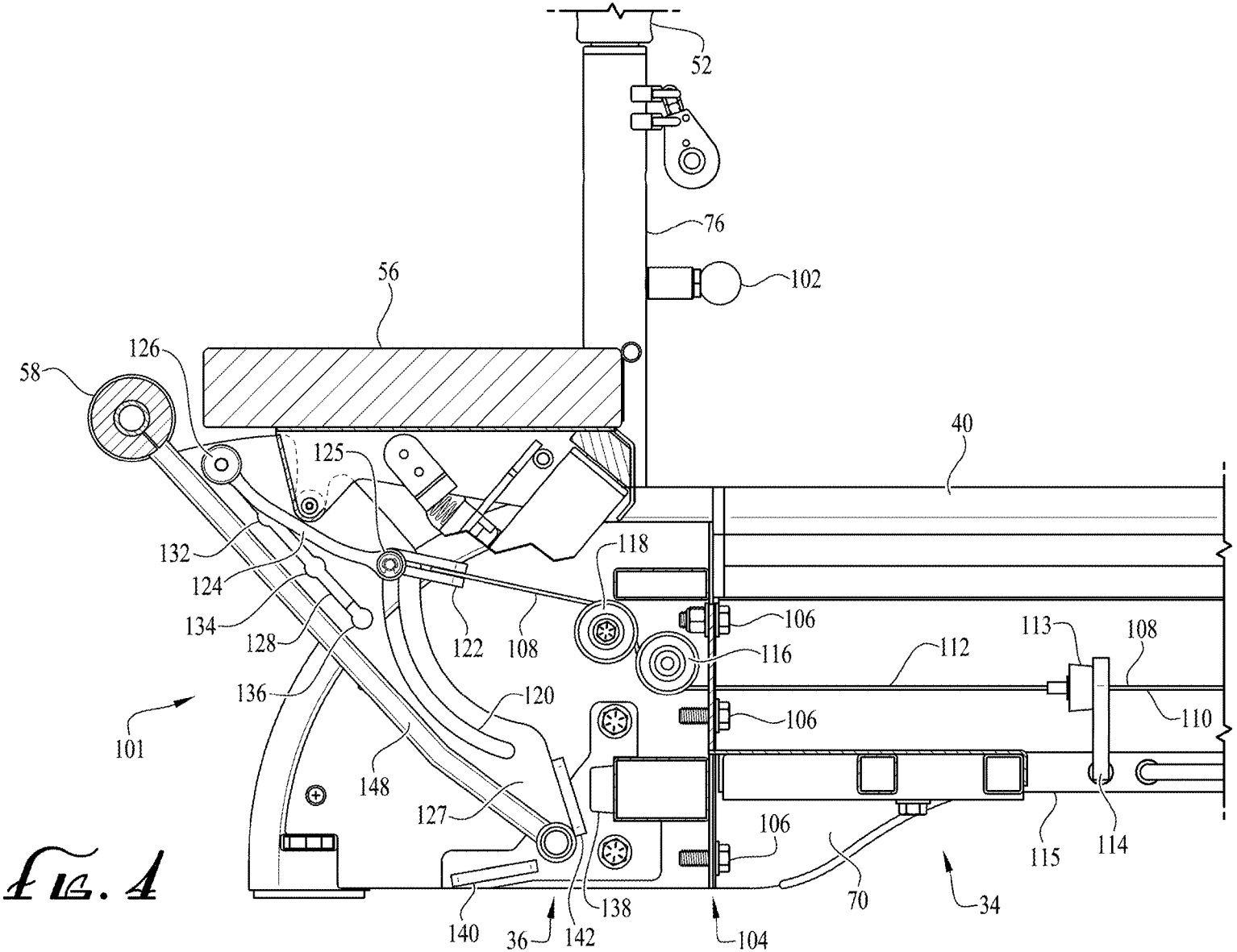
FIG. 4 is a cross-sectional view of the back assembly of the present exercise device, showing the pedal resistance system in the non-tensioned or reduced tension state, set at a first resistance level and with the seat in the lowered position.
Figure 5:
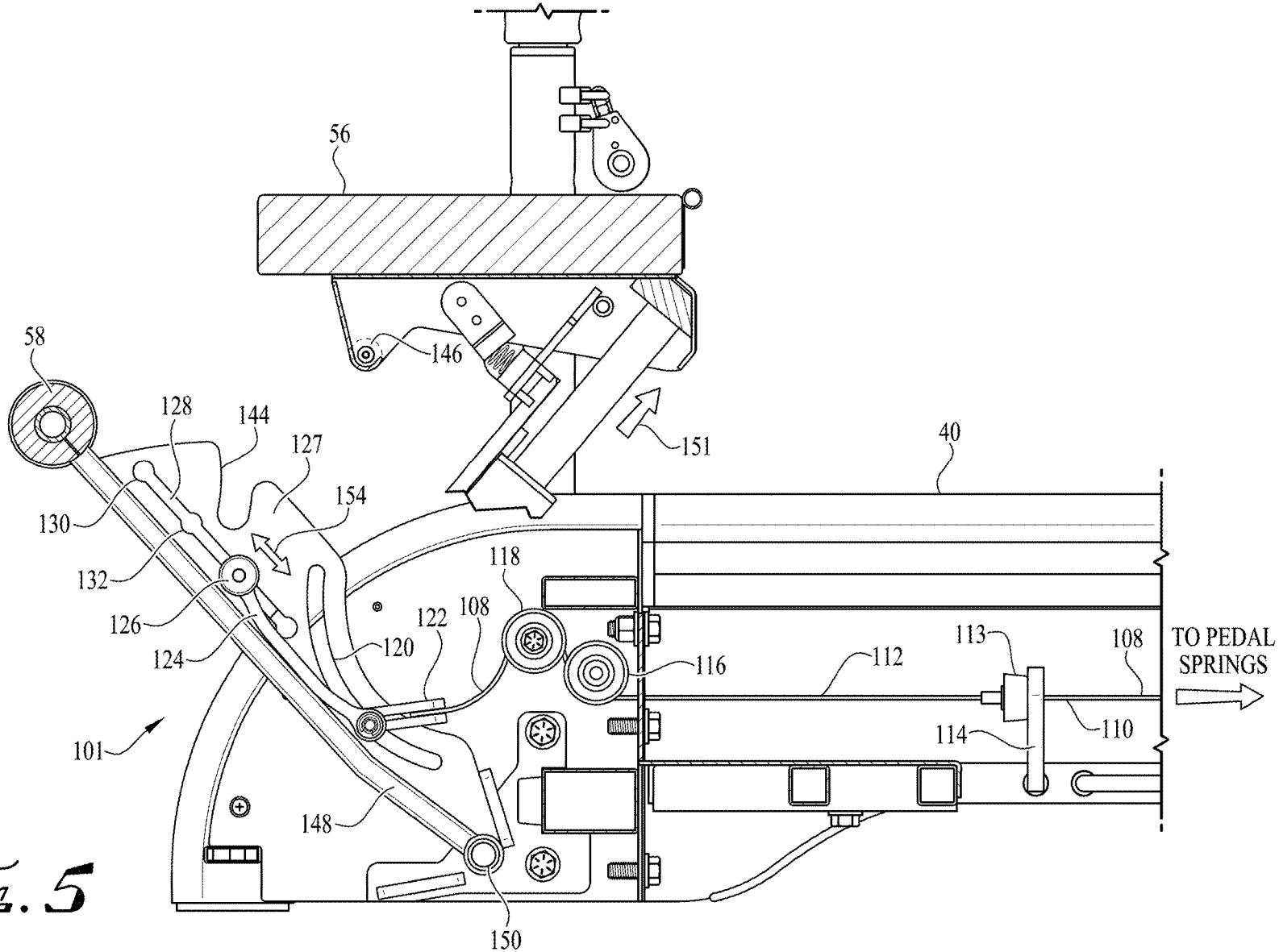
FIG. 5 is a cross-sectional view of the exercise device of FIG. 4, showing the pedal resistance system in the non-tensioned or reduced tension state, being set at a third resistance level and with the seat in the raised position.
Figure 6:
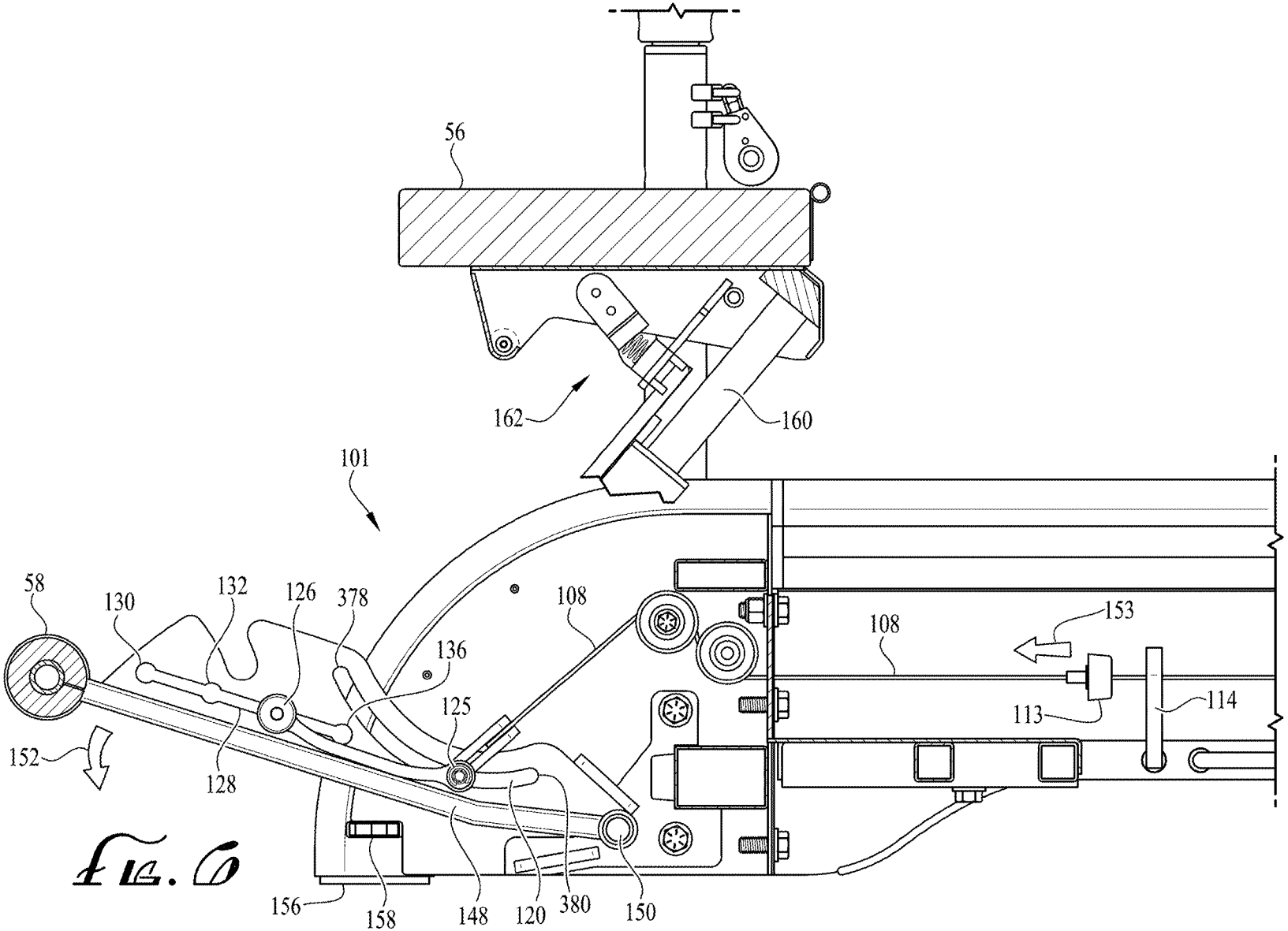
FIG. 6 is a cross-sectional view of the exercise device of FIG. 4, showing the pedal resistance system in the tensioned state where the pedal is forced down against resistance, and being set at a third resistance level and with the seat in the raised position.
Figure 7:
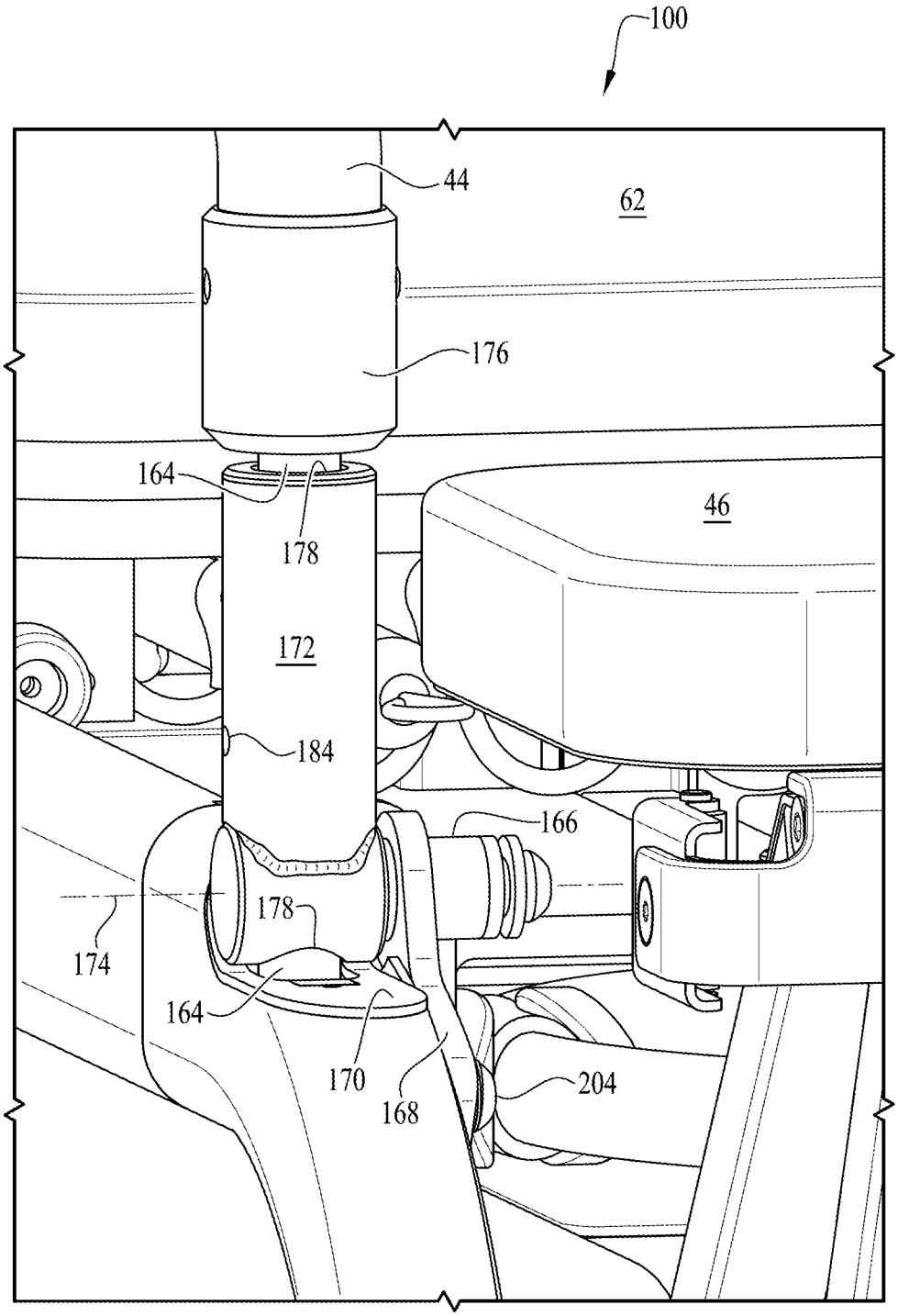
FIG. 7 is a magnified front perspective view of the footbar tilt mechanism.
Figure 18:
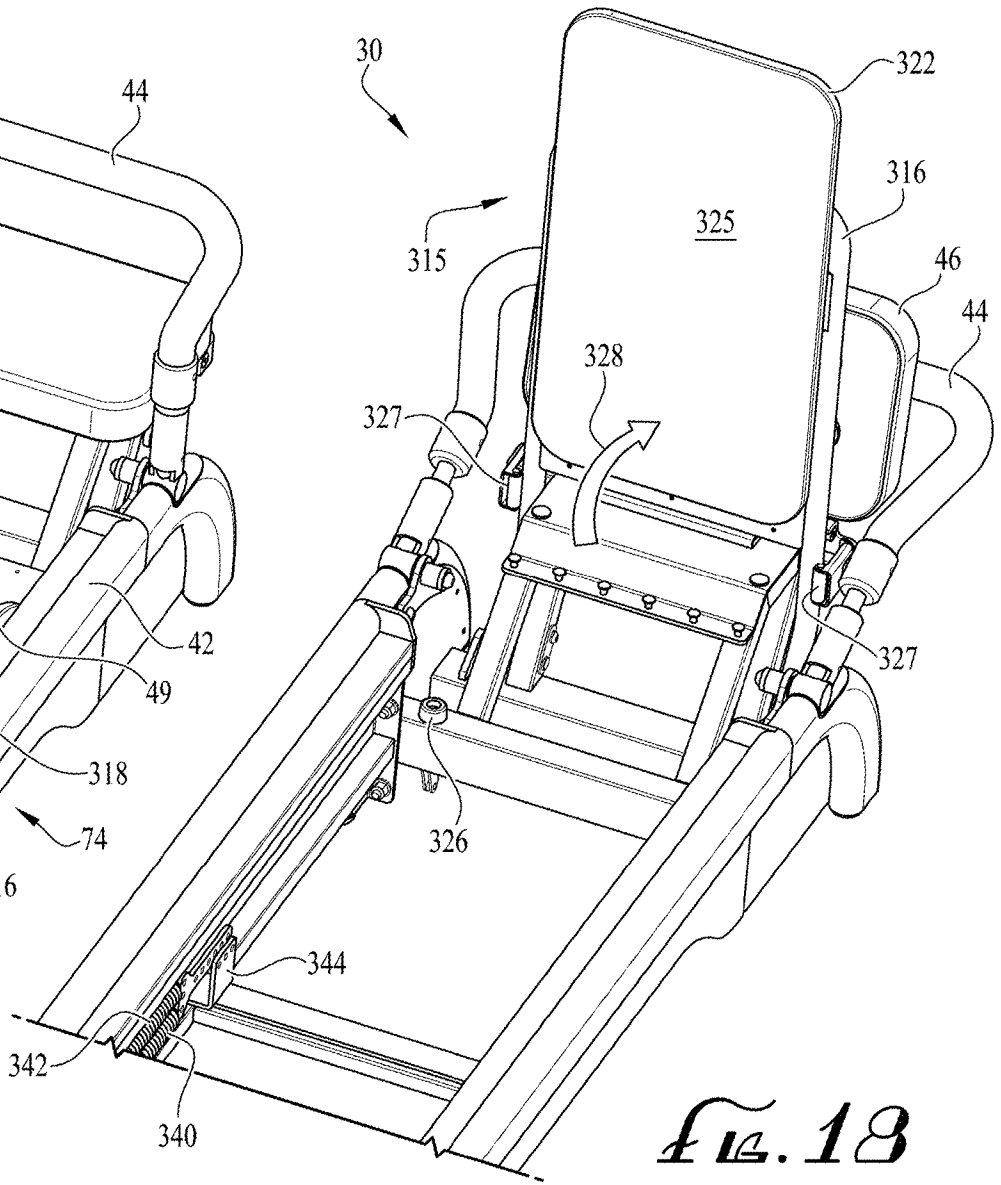
FIG. 18 is a top-back perspective partial view of the exercise device of FIG. 17, showing the jump board assembly tilted up, ready for the jump board to be deployed.
Figure 20:
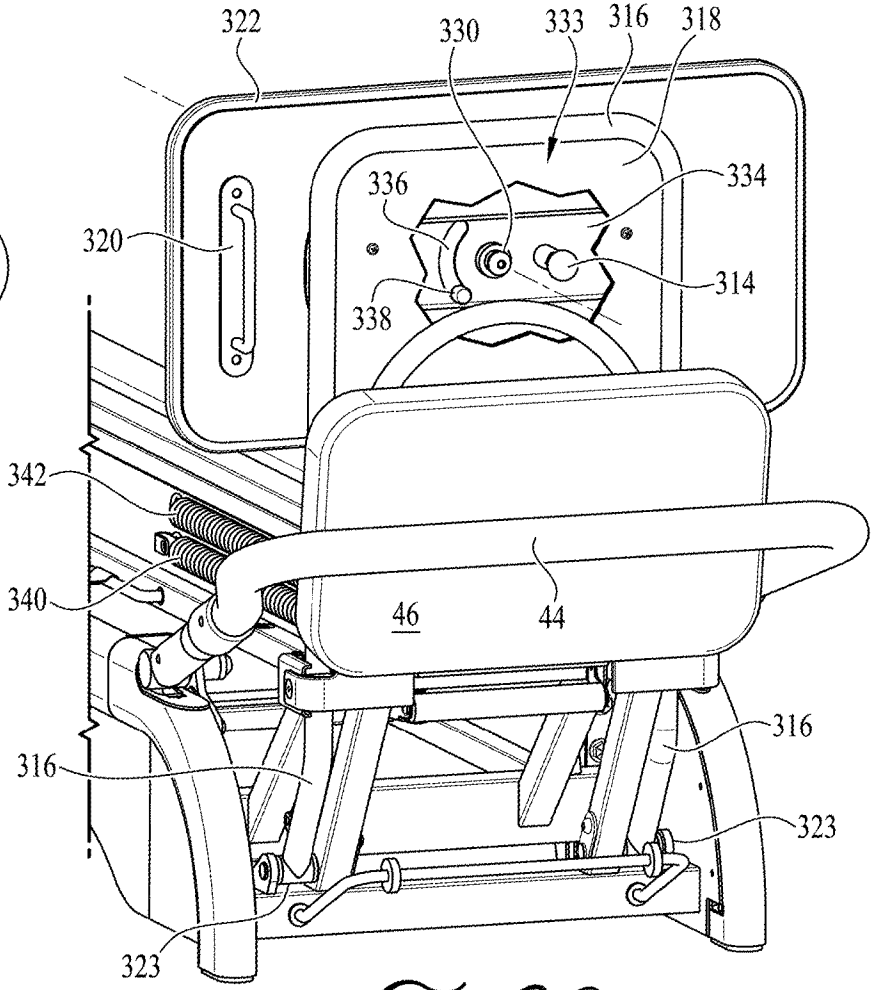
FIG. 20 is a top-front perspective partial view, with a broken-out section view, of the present exercise device of FIG. 17, showing the rotation locking mechanism.

Turning now to FIGS. 4-6, a pedal resistance adjustment mechanism 101 is illustrated. Because there is great difficulty in changing resistance levels when pedals are under resistance, the present mechanism 101 automatically relieves the tension in the resistance cable 108 when the pedal is in the initial position (with the pedal 58 in the highest or near highest position) to permit the adjustment in resistance level to be made. Referring also to FIGS. 18 and 20, resistance to the pedals 58, 60 is provided by a resistance source, in this example embodiment two extension springs 340, 342, each connected at one end to the frame 32 through the pedal spring bracket 344, with the opposite ends being connected to resistance cable 108 (or other appropriate linkage, flexible or substantially rigid), such that the spring force produced by extending the extension springs 340, 342 produces a tension in the cable 108. Generally, the extension springs 340, 342 are optionally pre-stretched to produce a continuous tension on the resistance side 110 of the resistance cable 108 even when not in use, which keeps the springs quietly in place with at desired initial resistance level. The resistance cable 108 passes through a hole (not shown, but drilled parallel to the paper) in the face of the resistance bracket plate 114, which is mounted to the frame 32. Crimped or otherwise secured to the resistance cable 108 is a stop 113, which is generally comprised of a metal crimp and a rubber cylinder to quiet any contact with the resistance bracket plate 114. When the stop 113 is rested on the resistance bracket plate 114 and the pedal 58 is located in the highest position (as shown in FIGS. 4 and 5), tension is released, minimized, and/or reduced on the pedal side 112 of the resistance cable 108. In this configuration, the resistance side 110 of the resistance cable 108 will have a higher tension than the pedal side 112 of the resistance cable 108, due to the resistance bracket plate 114 bearing the tension when the stop 113 rests against the resistance bracket plate 114.

Because the tension on the pedal side 112 of the resistance cable 108 is near zero or greatly reduced, the resistance level of the pedal resistance adjustment mechanism 101 can be easily changed without binding or other difficulties. Optional pulleys 116, 118 are mounted to the frame 32 and serve to provide a bending point (e.g., a directional change or shift) for the resistance cable 108 as the resistance level is changed and also serve to change the height of the resistance cable 108 to match the height of mating components and to avoid abrasion with other portions of the present device 30.

The end of the resistance cable 108 may include a ball 370, enlarged head, or other attachment means (swaged, brazed, crimped, etc., onto the end of the cable 108) which can be captured within the cable hook 122, which is much like a modified clevis, comprising a U-shaped metal strip with a longitudinal slot 368 which provides clearance to permit the cable 108 to travel through the slot 368, but is too narrow to permit the ball 370 to travel through, thus trapping the end of the resistance cable 108 to the cable hook 122. The cable hook 122 is attached to two linkage bars 124 (not to be mistaken with the linkage connected to the resistance source, a cable in this example) through pivoting joint 125 (only one linkage bar is possible in alternate embodiments). The pivoting joint 125 is created by inserting the end of the linkage 124 within the cable hook 122, and inserting and securing a pin 372 through the two linkage bars 124 the cable hook 122, with the pin retained therein by a retaining ring or the like. During assembly, the pin 372 is also inserted through an arced slot 120 formed through a resistance plate 127, to connect the pivot joint 125 (and the end of the linkage 124 and cable 108) to the arced slot 120, so that travel of the pivot joint 125 and the proximal end of the linkages 124 are restricted to the arced slot 120, with the pin 372 riding within the arced slot 120 with the linkages 124 on each side of the resistance plate 127.

The resistance plate 127 is attached to the pedal arm 148 by welding, fasteners, or other appropriate attachment means, so that, as the pedal arm 148 rotates about the pedal axle 150 the resistance plate 127 rotates likewise. Transversely welded to the resistance plate 127 edge, is a bumper plate 142, which contacts a bumper stop 138 at the upper limit of the pedal arm 148 travel. A limiter plate 140 140 is attached to the frame 32 to establish the lower limit of the pedal arm 148 travel.

Figure 4A:
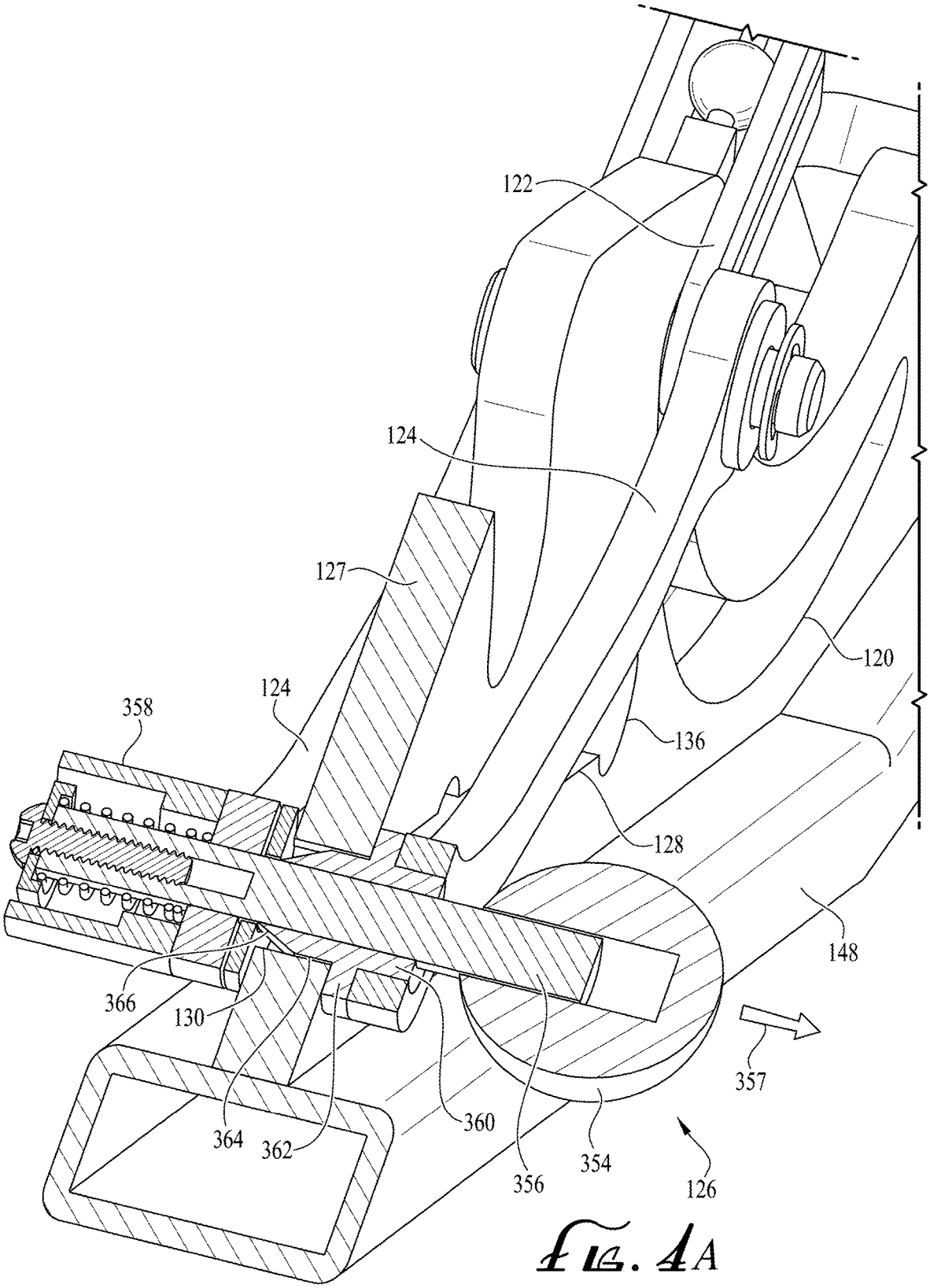
FIG. 4A is a cross-sectional perspective view of the pedal resistance system of FIG. 4.
Figure 4B:
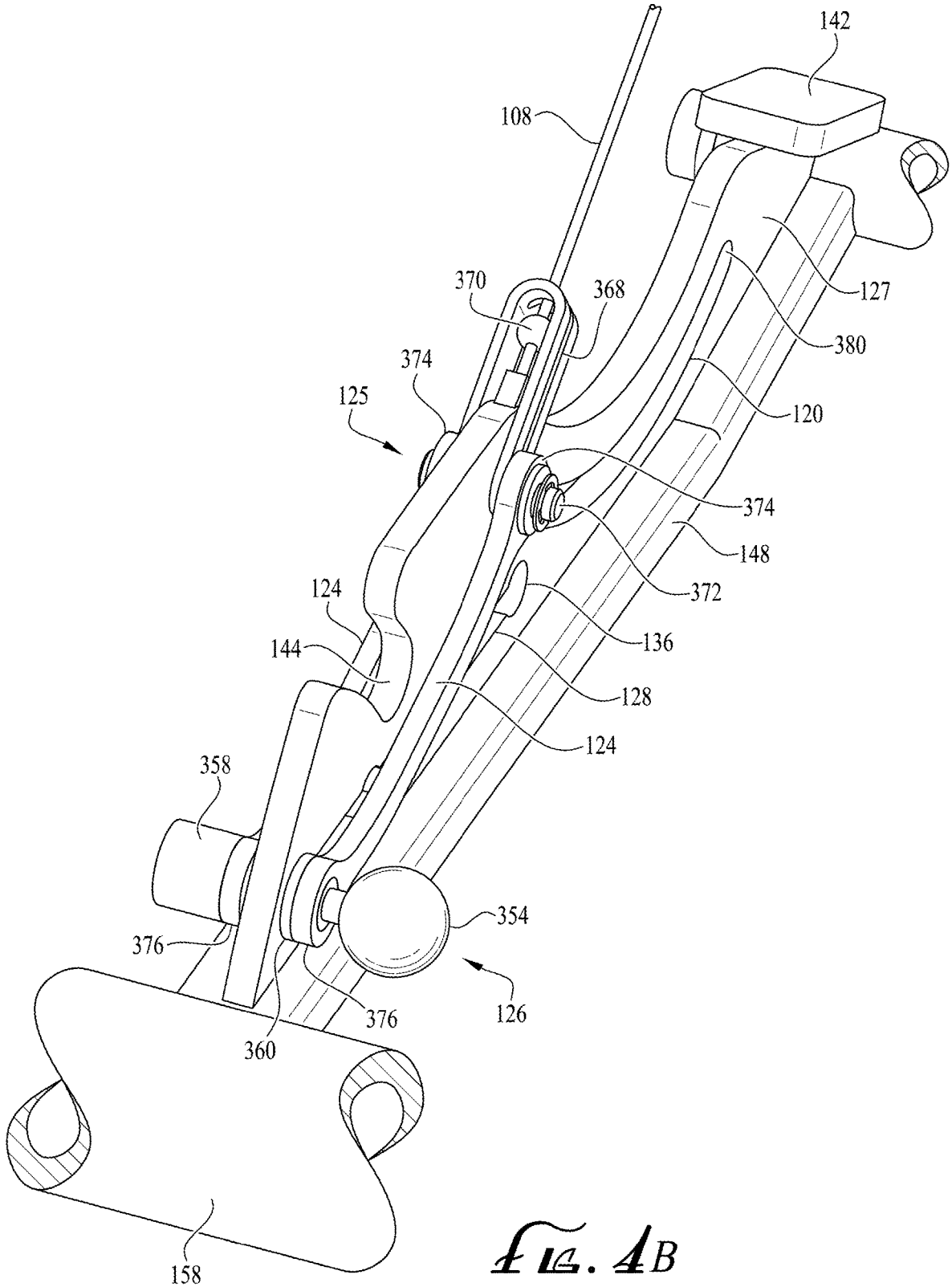
FIG. 4B is a cross-sectional perspective view of the pedal resistance system of FIG. 4.

The resistance plate 127 further includes a resistance setting slot 128, although the resistance setting slot 128 can be formed on another structure connected to the pedal arm 148. In this example embodiment, the resistance setting slot 128 is a linear slot with a series of enlarged portions formed at even or uneven increments along the resistance setting slot 128, forming the set holes 130, 132, 134, 136, which are created, for example, by drilling through the slot with a bit having a diameter larger than the slot 128. The set holes 130, 132, 134, 136 are each configured to hold in place distal ends 376 of the linkages 124, by selectively receiving a portion of the pull pin assembly 126 therein to prevent movement of the distal ends 376 relative to the resistance setting slot 128. Looking at FIGS. 4A-B, the pull pin assembly 126 includes a ball 354 to provide purchase for pulling the pin 356 as indicated by the arrow 357. The pin 356 is spring biased opposite the arrow 357, toward the resistance setting slot 128 by the spring unit 358 (internal compression spring not shown). A position set pin 360 is firmly attached or integral with the pin 356. The position set pin 360 includes a tapered or chamfered tip 366, a cylinder locking portion 364, and a shoulder 362 set back from the chamfered tip 366, with the cylinder locking portion 364 between the two, and arranged axially on the pin 356. The chamfered tip 366 acts as a lead-in to guide the set pin 360 into engagement with the set holes 130, 132, 134, 136, when aligned.

To change the resistance level applied to the pedal 58 against the exerciser's effort, the pull pin assembly 126 with the distal ends 376 of the linkages 124 can be moved between set holes 130, 132, 134, 136, changing the length of the lever arm. In this example embodiment, it follows that the pull pin assembly 126 being locked into position at set hole 130 produces maximum resistance, and being locked into position at set hole 136 produces minimum resistance. More specifically, to change the resistance setting, the pedal 58 should be in its highest position (or 1-3 inches nearby), as shown in FIGS. 4 and 5, to release the tension in the resistance cable 108. In this position, the pedal arm 148 does not exert a significant amount of tension on the pedal side 112 of the resistance cable 108, permitting the stop 113 and the bracket 114 (or other portion of the frame or part rigidly connected directly or indirectly to the frame) to bear the full load of the resistance. In this way, the pedal side 112 of the resistance cable 108 becomes somewhat slack so that the exerciser can easily slide the pull pin assembly 126 and linkages 124 up and down the resistance set slot 128 when pull pin assembly 126 is actuated (as indicated by arrow 154). Looking again at FIG. 4A, to activate the pull pin assembly 126, the exerciser pulls on the ball 126 in the direction of arrow 357 to remove the cylinder locking portion 364 of the set pin 360 from the set hole 130, 132, 134, 136 within which it is initially locked. The cylinder locking portion 364 is slightly smaller in size than the set holes 130, 132, 134, 136, but larger than the resistance set slot 128, so that the cylinder locking portion 364 drops into one of the set holes 130, 132, 134, 136 and is not permitted to move out. Once the cylinder locking portion 364 of the set pin 360 from the set hole (hole 130 in FIG. 4), the pin 356 is permitted to move within the resistance set slot 128, as its diameter is less than the resistance set slot 128 width. If the exerciser wishes to move from one set hole to the neighboring set hole, she need only to pull the pull pin assembly 126 to disengage, move the pull pin assembly 126 slightly out of alignment with the set hole 130, 132, 134, or 136, release the pull pin assembly 126, where the chamfered tip 366 rides on the resistance set slot 128, allowing the pull pin assembly 126 to engage automatically when the cylinder locking portion 364 aligns with the neighboring set hole 130, 132, 134, or 136. The exerciser can also continually actuate the pull pin assembly 126 to slide it to any set hole 130, 132, 134, or 136.

Figure 17:
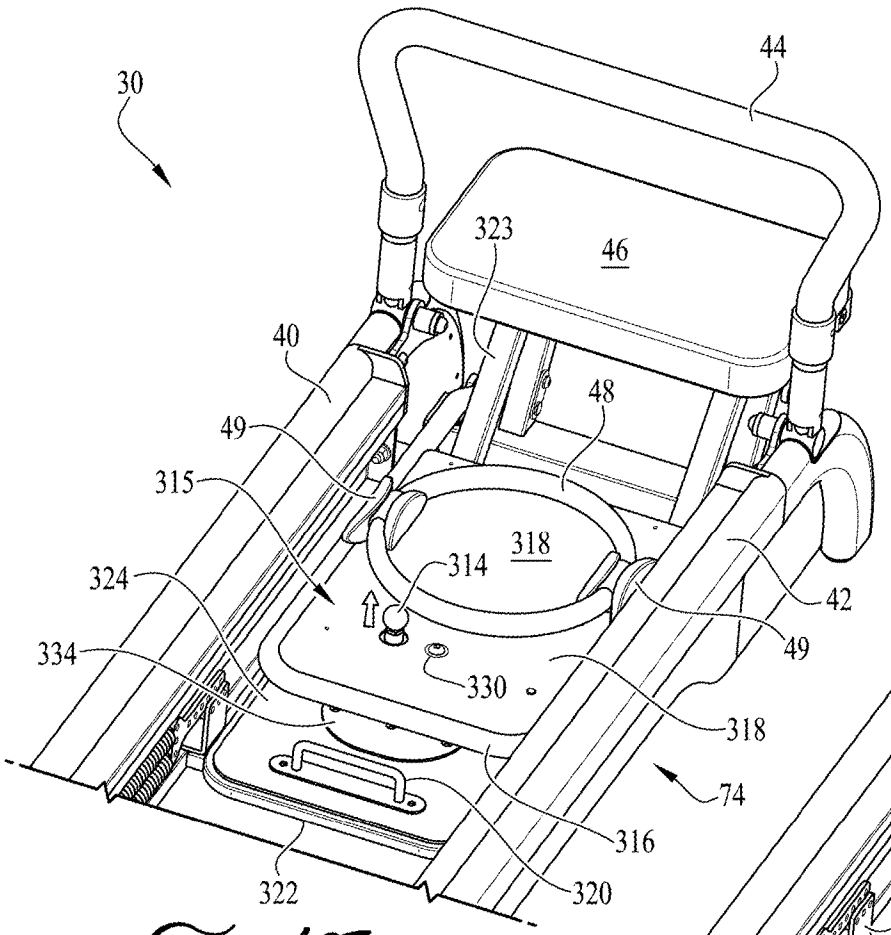
FIG. 17 is a top-back perspective partial view of the present exercise device, with the carriage moved forward to expose the jump board assembly thereunder.

Comparing FIG. 4 to FIGS. 5-6, it can be seen that the pull pin assembly 126 is moved from set hole 130 to set hole 134, thus reducing the resistance applied to the pedal arm 148, by increasing the lever arm. The resistance from the springs 340, 342 (as shown in FIGS. 17, 18, and 20) is applied to the arced slot 120, where the position of the pivot joint 125 within the arced slot 120, in fact, changes the lever arm. The pin 372 of the pivot joint 125 is held in positon in the arced slot 120 by the rigid linkages 124 being held in positon by the pull pin assembly 126 being locked in one of the set holes 130, 132, 134, or 136 as described above. When an exerciser pushes down on the pedal 58 (as indicated by arrow 152 in FIG. 6), the pivot joint 125 does not slide relative to the arced slot 120, but instead, is held in position between the first end 378 and the second end 380 of the arced slot 120, as the pedal 58 is pushed down to pull the resistance cable, as indicated by arrow 153.

In this example embodiment, the addition of the linkage 124 moves the pull pin assembly 126 from deep within the pedal mechanism toward the pedal 58, allowing easy and safe access for the exerciser to quickly change the resistance during a routine. Of course, the linkage 124 and resistance set slot 128 are optional, as the tension relief provided by the stop 113 and bracket 114 do not require any specific resistance set means. In one alternate example, the linkage 124 and resistance set slot 128 are eliminated, with the pull pin assembly 126 positioned at the arced slot 120, where the pivot joint 125 is located, where the arced slot 120 is modified to include the set holes 130, 132, 134, 136.

Although, the resistance adjustment system/mechanism is described herein as a pedal resistance adjustment mechanism 101, the resistance adjustment mechanism can be connected to a variety of exerciser purchases (e.g., a hand hold, foot hold, etc., and other connected linkages), where the exerciser can change resistance without disconnecting from the resistance source.

Looking now at FIGS. 7-10, an exemplary embodiment of the tilt adjustment mechanism 100 is illustrated, which permits the footbar 44 to tilt or rotate from the direction of the front end 88 to the direction of the back end 90, rotating about the pivot assembly 166. In the example embodiment, the footbar 44 can be held at one of three discrete angular position relative to the frame assembly 32, plus a stowed position laying near or at horizontal or, minimally, out of the way. As both sides are generally the identical in concept and operation, only one side of the tilt adjustment mechanism 100 is described herein. The pivot assembly 166, in this example, includes a shaft aligned with the axis of rotation 174, and creating a hinge between the pivot support bracket 168 (attached firmly to the frame by fasteners 204) and the sleeve 172, using bushings, bearings, ball bearing, or other means of permitting smooth rotation under load. The footbar 44 generally has a horizontal top tube portion extending laterally across the frame 32 with two vertical side tubes on each side of the frame 32 extending downward. In this example embodiment, a collar 176 secures a rod 164 at the terminus of the vertical side tube of the footbar 44. The rod 164 telescopically sides into the sleeve 172, such that the rod 164 can axially slide within the sleeve 172 by pulling upward (as indicated by arrow 196) or pushing downward (as indicated by arrow 198) on the footbar 44. Optionally, a bushing 165 lines the inner surface of the sleeve 172 to prevent chatter and looseness in the telescoping connection and to provide a pleasing feel.

Figure 8:
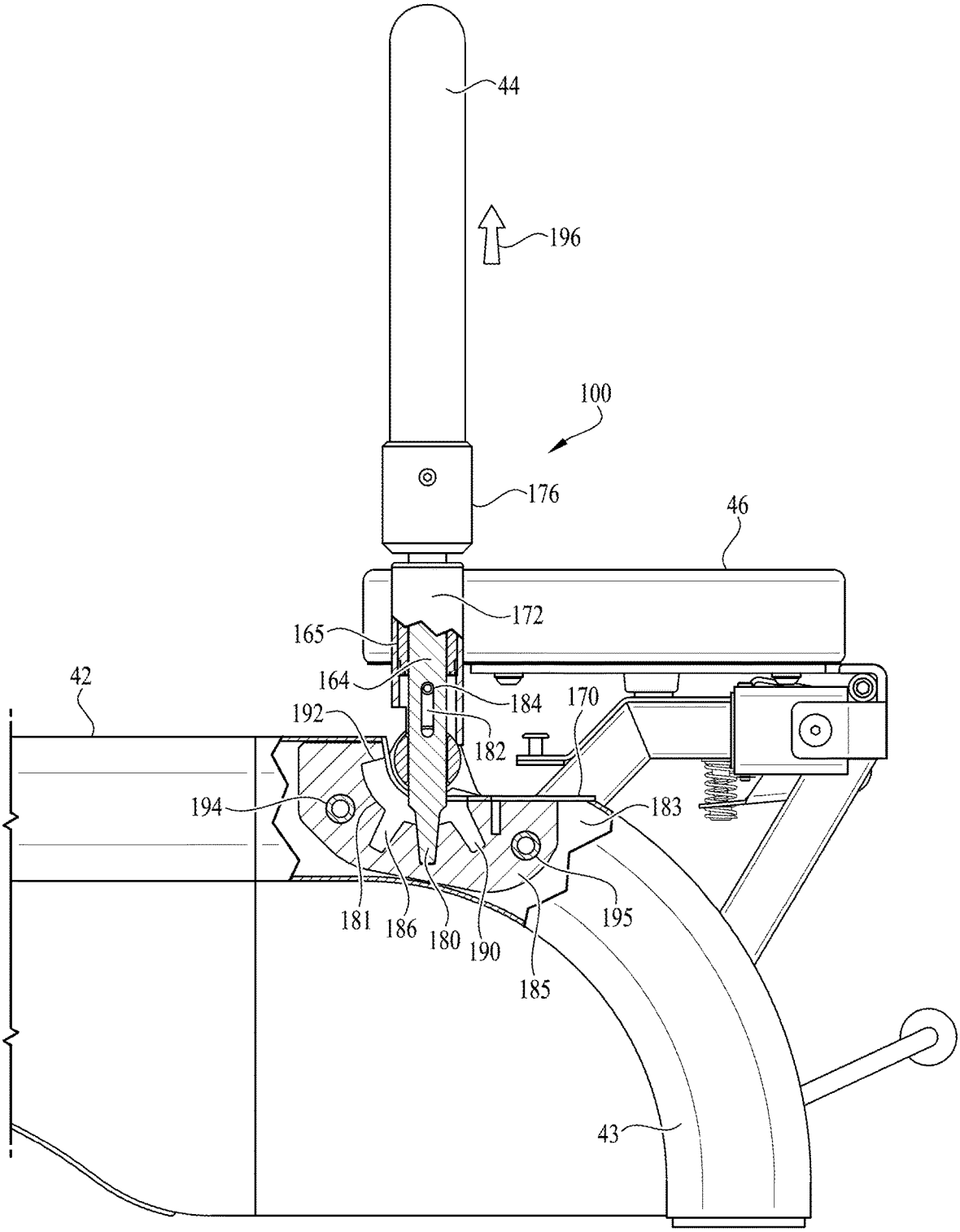
FIG. 8 is a partial cross-section of the front assembly, showing the footbar tilt mechanism, with the footbar locked in the first position.

Referring to FIG. 8, the rod 164 is inserted completely through the sleeve 172, with the distal tip 180 extending into the interior 183 of the leg 43 of the frame assembly 32. The distal tip 180, in one example, is wedge-shaped (tapered on both sides) to permit easy location and insertion into complementary shaped locating notches 186, 188, 190, as will be described further below. A tilt lock plate 185 is secured to the interior 183 of the leg 43, positioned within the interior by threaded bosses 194, 195, which act as spacers to located the tilt lock plate 185 and to receive the fasteners 204, tightly securing the tilt lock plate 185 in the interior 183. The locating notches 186, 188, 190 are formed on an arc-shaped edge 181 at the top of the tilt locking plate 185. The locating notches 186, 188, 190 are generally formed radially from the center of rotation 174. At one end of the arc-shaped edge 181 a protruding of the tilt lock plate 185 toward the center of rotation 174 forms a stop 192, to limit the clockwise rotation of the footbar 44, where the footbar 44 would be horizontal or nearly horizontal to the side rail 42 when the distal tip 180 is engaged against the stop 192. A cover plate 170 is fastened to the leg 43 to at least partially enclose the interior 183.

Figure 9:
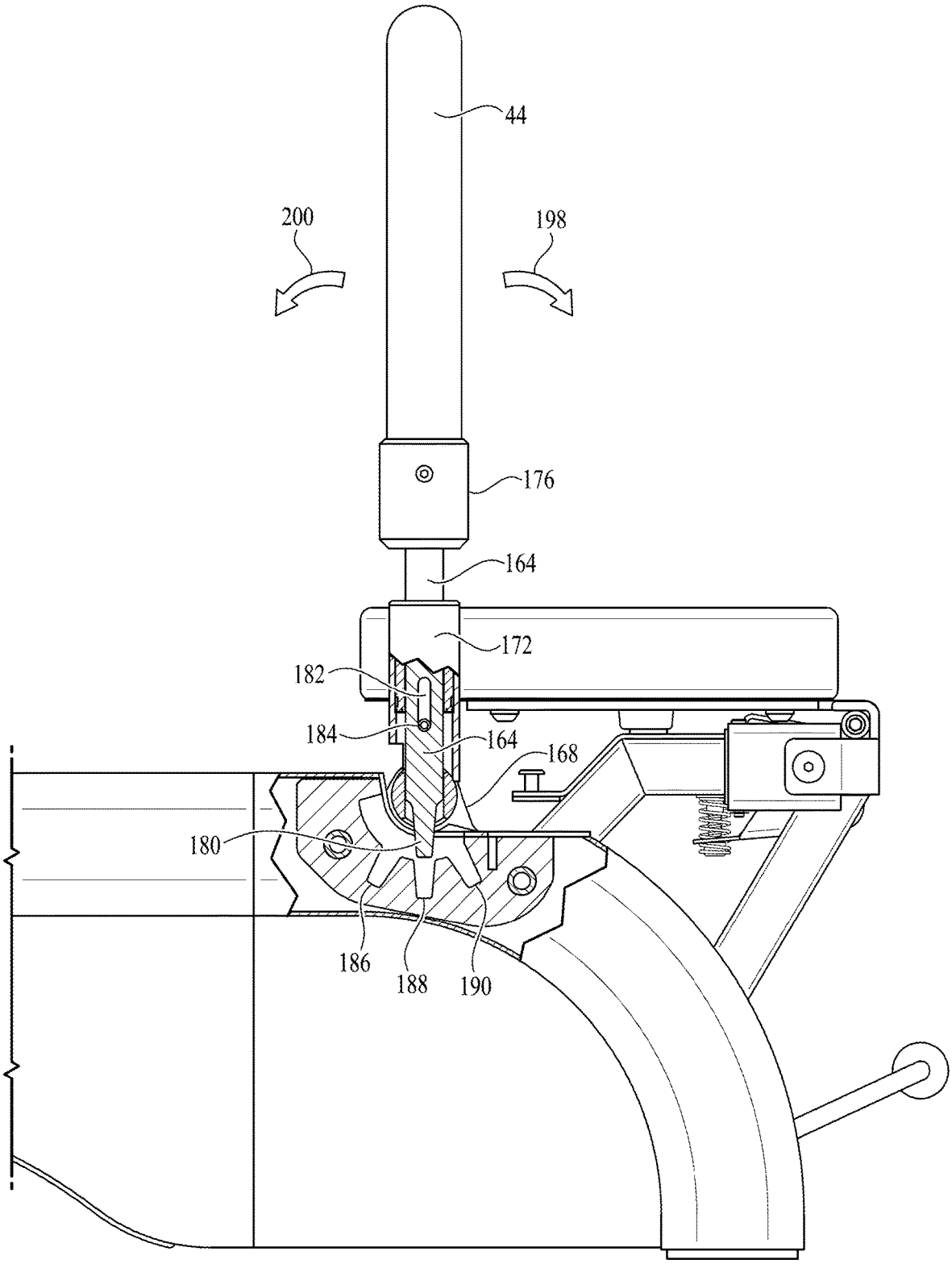
FIG. 9 is a partial cross-section of the front assembly of FIG. 8, showing the footbar tilt mechanism, with the footbar lifted and unlocked for changing the tilt angle.
Figure 10:
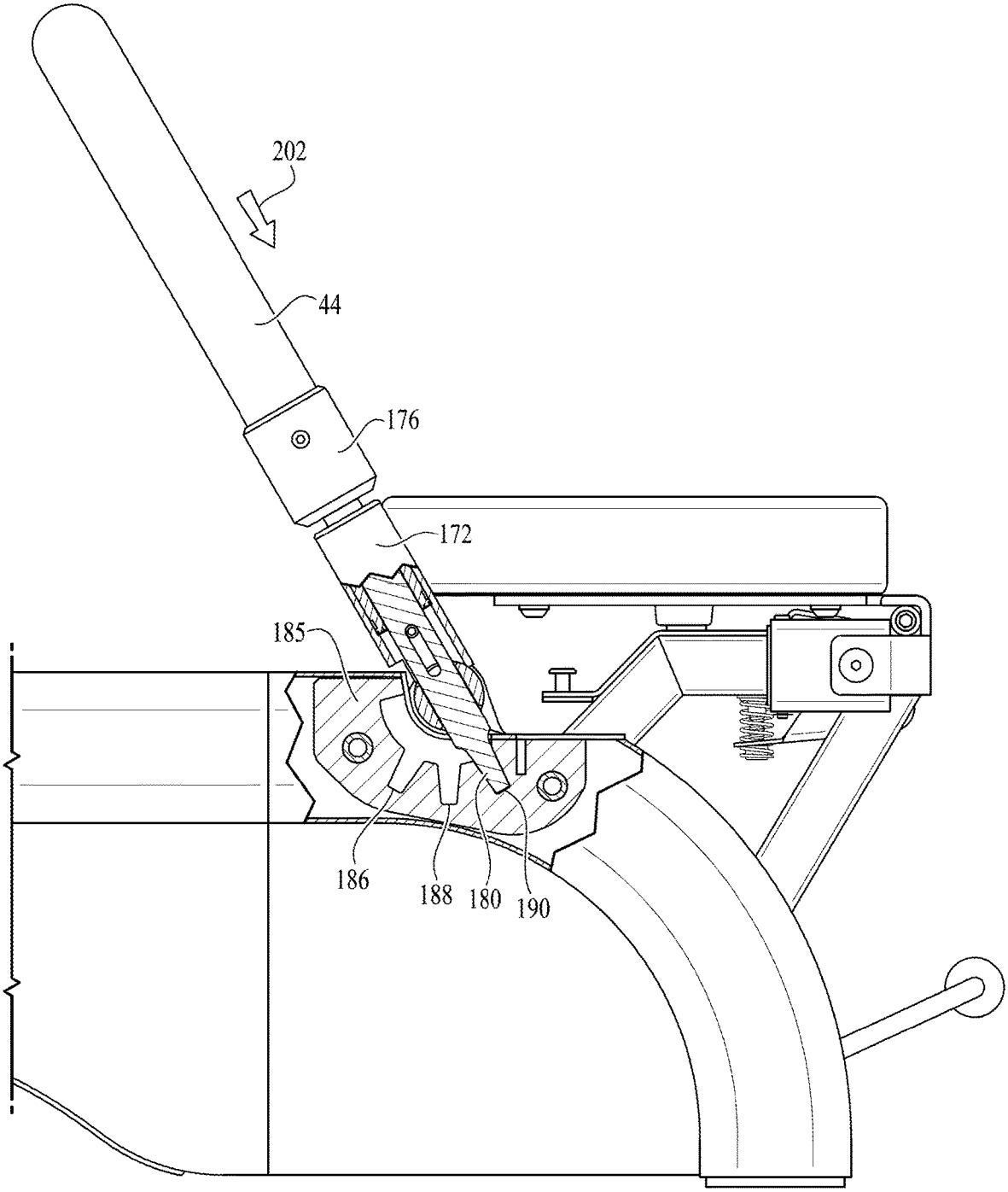
FIG. 10 is a partial cross-section of the front assembly of FIG. 8, showing the footbar tilt mechanism, with the footbar locked in a second position.

To permit axial sliding of the rod 164 within the sleeve 172 over a limited displacement, a limiting slot 182 is formed through the rod 164, which receives therethrough a pin 184 that is press fit or otherwise secured through the sleeve 172 at each end, effectively holding the rod 164 within the sleeve 172. The travel of the rod 164 is limited by the length of the limiting slot 182, which permits enough travel to lift the distal tip 180 from its respective locating notch 186, 188, or 190, as seen in FIG. 9. It can be seen that the distal tip 180 is initially located in locating notch 188 to hold the foot bar 44 in a vertical orientation. As the footbar 44 is lifted up, the distal tip 180 is lifted out of and clear of the locating notch 188, and is ready for repositioning into another locating notch by rotating the footbar 44 clockwise or counterclockwise, as indicated by arrows 198, 200. One the distal tip 180 is aligned with the desired locating notch (190 in this example), the foot bar can be pushed down and toward the locating notch 190 (as indicated by arrow 202) to insert the distal tip 180 into the locating notch 190; thus, locking the angular position of the foot bar 44.

Figure 11:
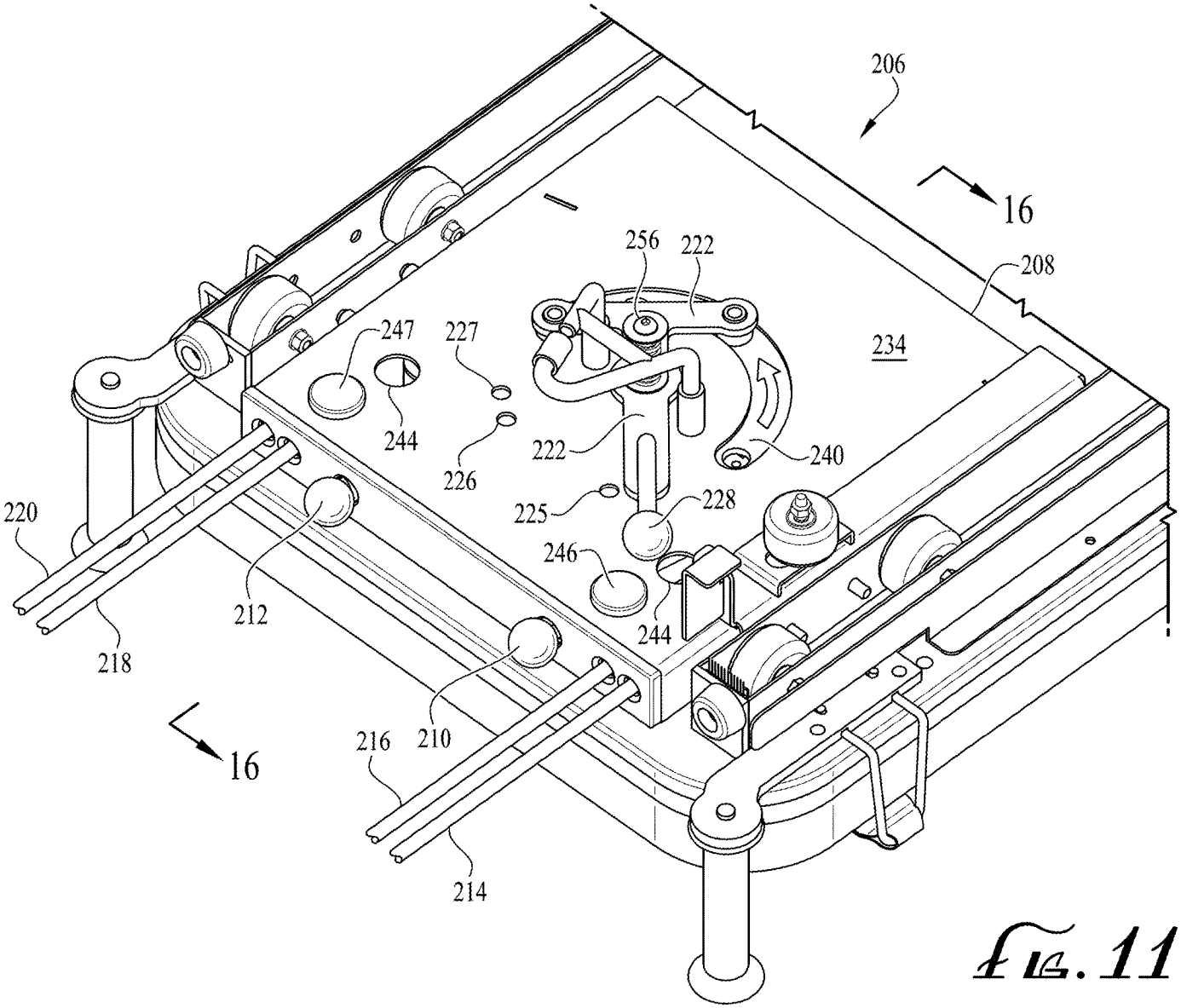
FIG. 11 is a bottom perspective view of the rope adjustment system attached to the bottom of the carriage assembly.
Figure 12:
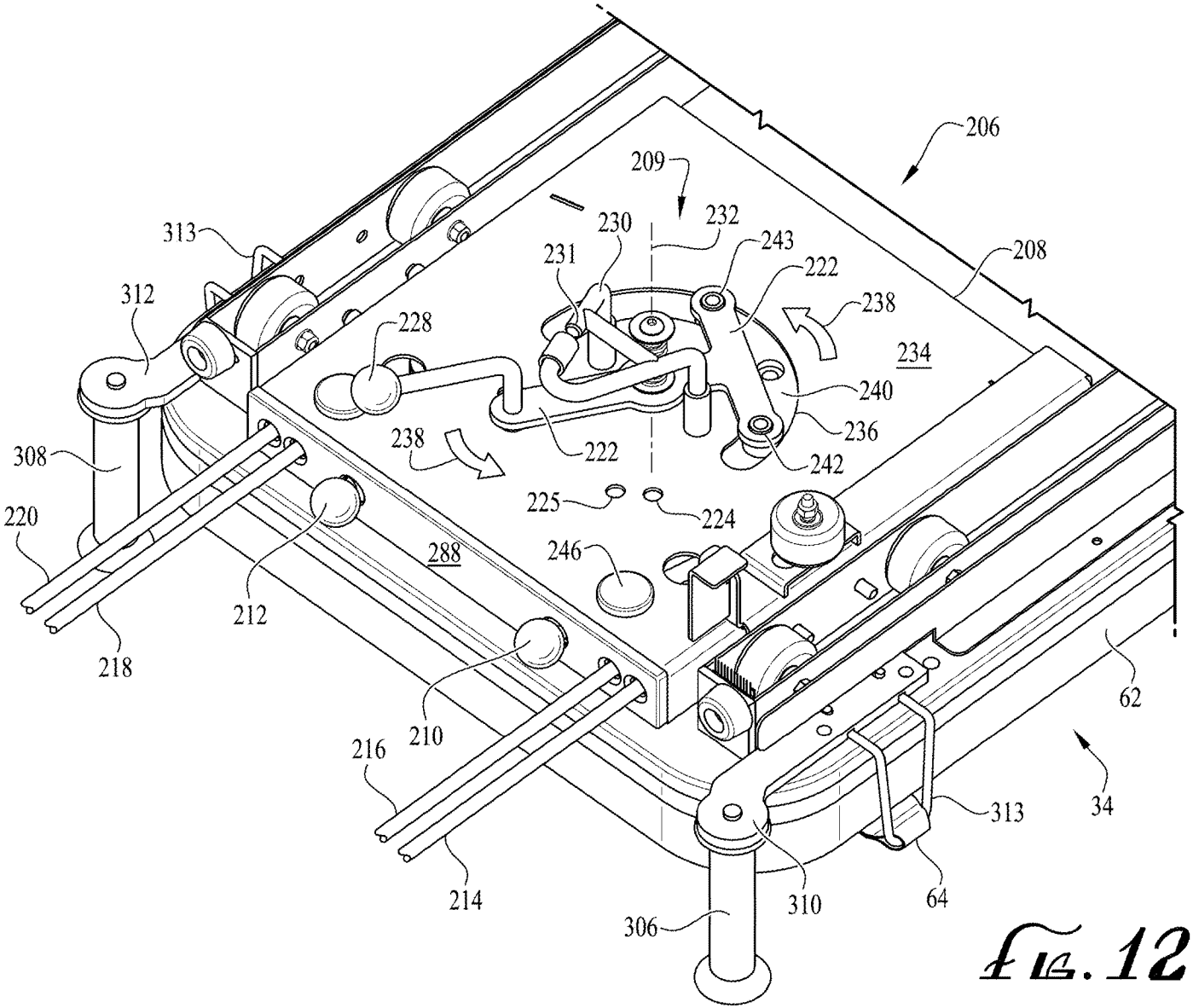
FIG. 12 is a bottom perspective view of the rope adjustment system of FIG. 12, with the handle moved to rotate the adjustment wheel.

Turning now to FIGS. 11-16, an example embodiment of the rope adjustment assembly 206 is shown in greater detail and isolated from much of the remaining exercise device 30. FIGS. 11 and 12 illustrate rope adjustment assembly 206 mounted to the underside of carriage assembly 34. The rope adjustment assembly 206 has an enclosure 208 supporting the various components on and within the enclosure 208. A handle assembly 209 is positioned on the bottom face 234 of the enclosure 208 and connects with an adjustment wheel 240 positioned within the enclosure 208 through arced slot 236. The purpose of the handle assembly 209 is to shorten or lengthen all the ropes 214, 216, 218, 220 connected to the rope adjustment assembly 206, but permitting the turning of the adjustment wheel 240. The enclosure 234 includes through holes to receive thumb screws 246, 247 (basically, knurled knobs with a threaded stud), which thread into the underside of the carriage 62 (screwed into the substructure, such as a threaded insert attached to plywood, oriented strand board, medium density fiber board, etc.). The enclosure can hook to the underside of the carriage 62 at one side and be attached by the thumb screws 246, 247 on the other, to hold the enclosure 208 and attached components to the carriage 62, yet allow quick removal for inspection or repair. Inspection/access holes 244 or general openings for other purposes may be punched or cut through the bottom plate 234. Looking at the front plate 288 of the enclosure 208, there are four holes providing clearance for each of the four ropes 214, 216, 218, 220 exiting from the enclosure 208. Two further holes in the front plate 288 of the enclosure 208 provide clearance for the threaded shafts 260, 262 (discussed further below) to protrude from the enclosure 208, with a first adjustment knob 210 attached to the end of threaded shaft 260 and a second adjustment knob 212 attached to the end of threaded shaft 262.

Although the ankle strap rope mount 230 is also mounted on the bottom face 234 and is immediately next to the handle assembly 209, the ankle strap rope mount 230 and any connected rope is not part of the handle assembly 209. The ankle strap rope mount 230 includes an opening 231 to permit the looped end of a rope (not shown) to be hooked by the ankle strap rope mount 230. The opposite end of the rope would be threaded through the foot strap mechanism 346 illustrated in FIG. 2, and include an attachment on the distal end, such as an ankle strap, carabiner, etc.

The handle assembly 209 pivots on a spring pivot assembly 256 mounted to the bottom face 234 of the enclosure 208, and configured to selectively rotate about the axis 232. The handle assembly 209 includes rotation bracket 222 shaped like a "T", with a handle 228 extending from the stem of the "T" and a pin 223 extending from the bottom face of the stem toward the bottom plate 234. Fasteners 242, 243 insert through holes at each end of the arm of the "T" to fasten the rotation bracket 222 to the adjustment wheel 240 mounted on the opposite side of the bottom plate 234, with the fasteners accessing the adjustment wheel 240 through arced slot 236. The spring pivot assembly 256 permits the handle 228 to be pulled away from the bottom plate 234 by allowing the rotation bracket 222 to tilt relative to axis 232 against the force of the spring 292 (referring also to FIG. 16). As the handle 228 is tilted and pulled away from the bottom plate 234, the pin 223 is removed from one of the set holes 224, 225, 226, 227 (set hole 226 in this example). Once the handle 228 is lifted sufficiently to remove the pin 223 from set hole 226 in FIG. 11, the handle 228 can be rotated about axis 232 as indicated by arrows 238 (in a counter clockwise direction), which causes the adjustment wheel 240 to similarly rotate. The handle 228 may be continually lifted while being rotated or the pin 223 can slide across the bottom plate 234 until reaching the next set hole 224, 225, 226, or 227, where the pin 223 drops into the first set hole 224, 225, 226, or 227 encountered. In this example, comparing FIG. 11 to FIG. 12, the handle is move from set hole 226 to set hole 224. The result of rotating the handle 228 will be discussed in greater detail below.

Still referring to FIGS. 11 and 12, brackets 310, 312 are fastened to the underside of the carriage 62 on each back corner, and extend toward the back end 90 of the exercise device 30. The brackets 310, 312 each serve to hold respective strap anchors 313, which are sandwiched between the brackets 310, 312 and the underside of the carriage 62. The brackets 310, 312 extend toward the back end 90 and cantilever from the carriage 62. The cantilevered portions of the brackets 310, 312 each hold a handle 306, 308, which may be grasped by hand in certain exercises, or which may be used for other purposes, such as a pulley-like device for wrapping a rope about to change the direction of the rope.

Figure 14:
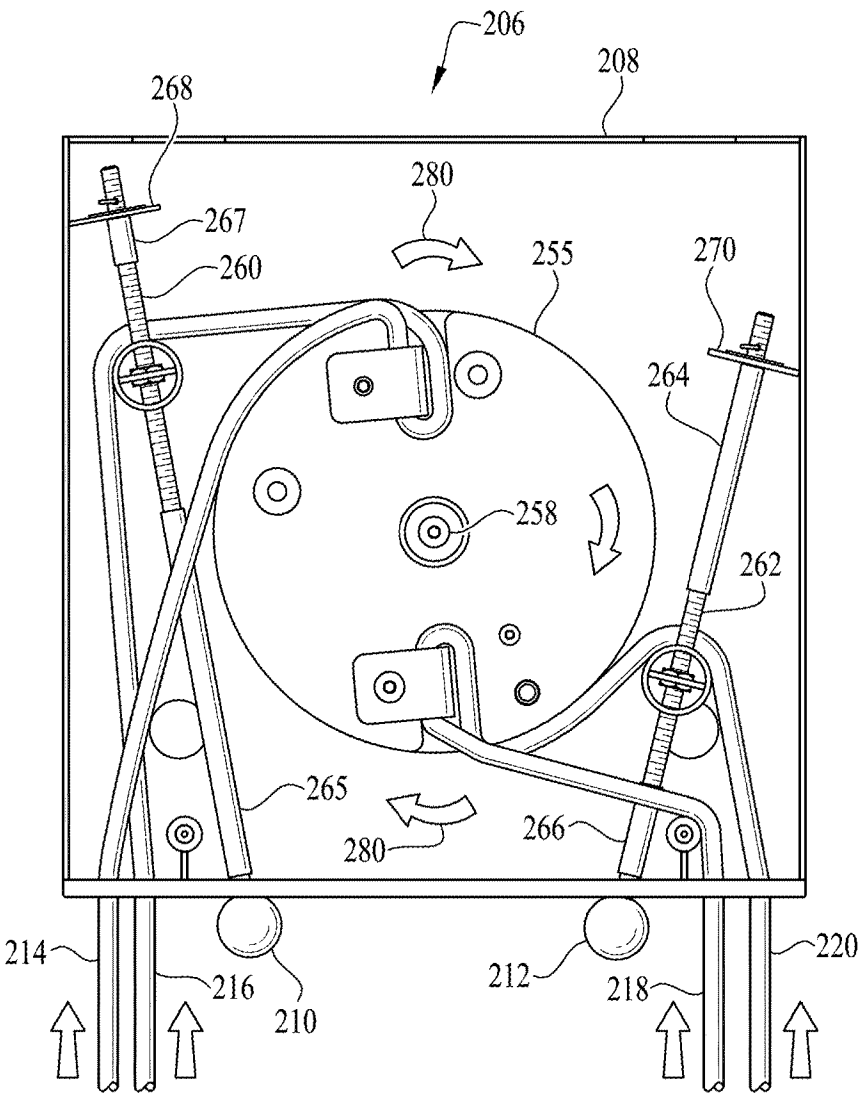
FIG. 14 is a plan view of the internal mechanism of the rope adjustment system of FIG. 12, in a reeled position.
Figure 13:
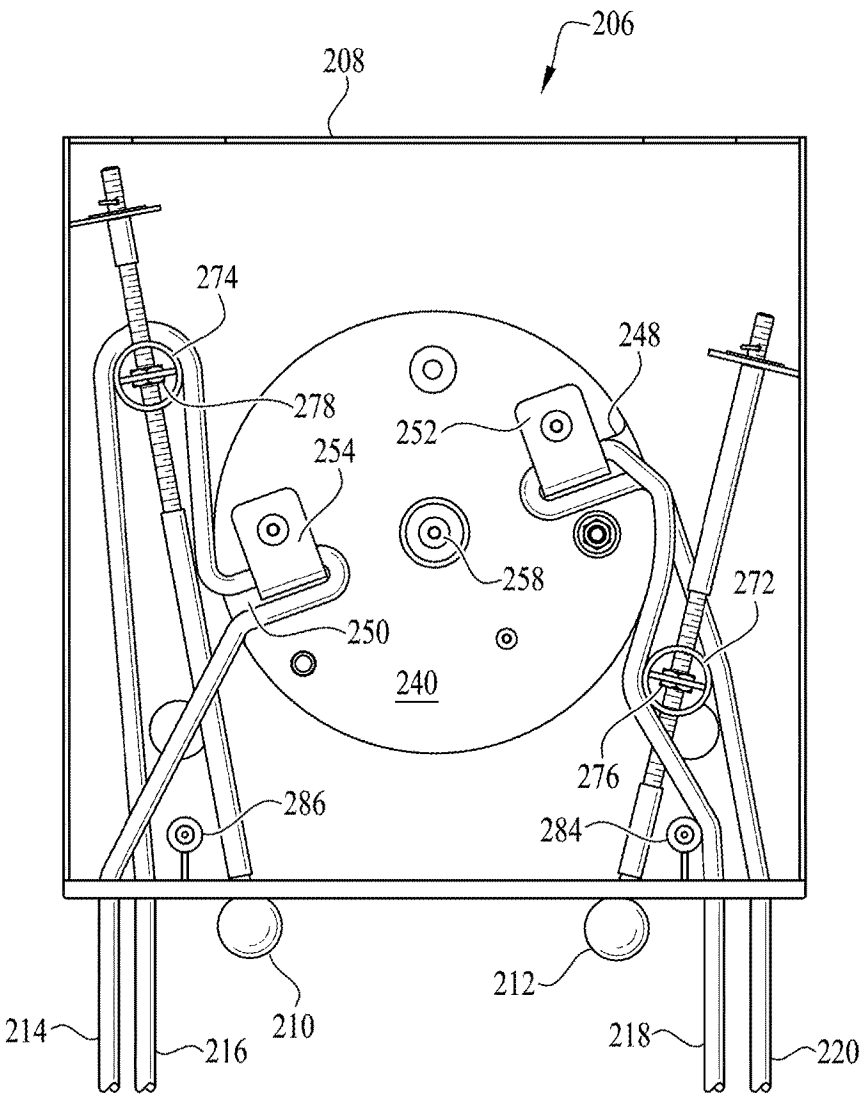
FIG. 13 is a plan view of the internal mechanism of the rope adjustment system of FIG. 12, in an unreeled position.
Figure 15:
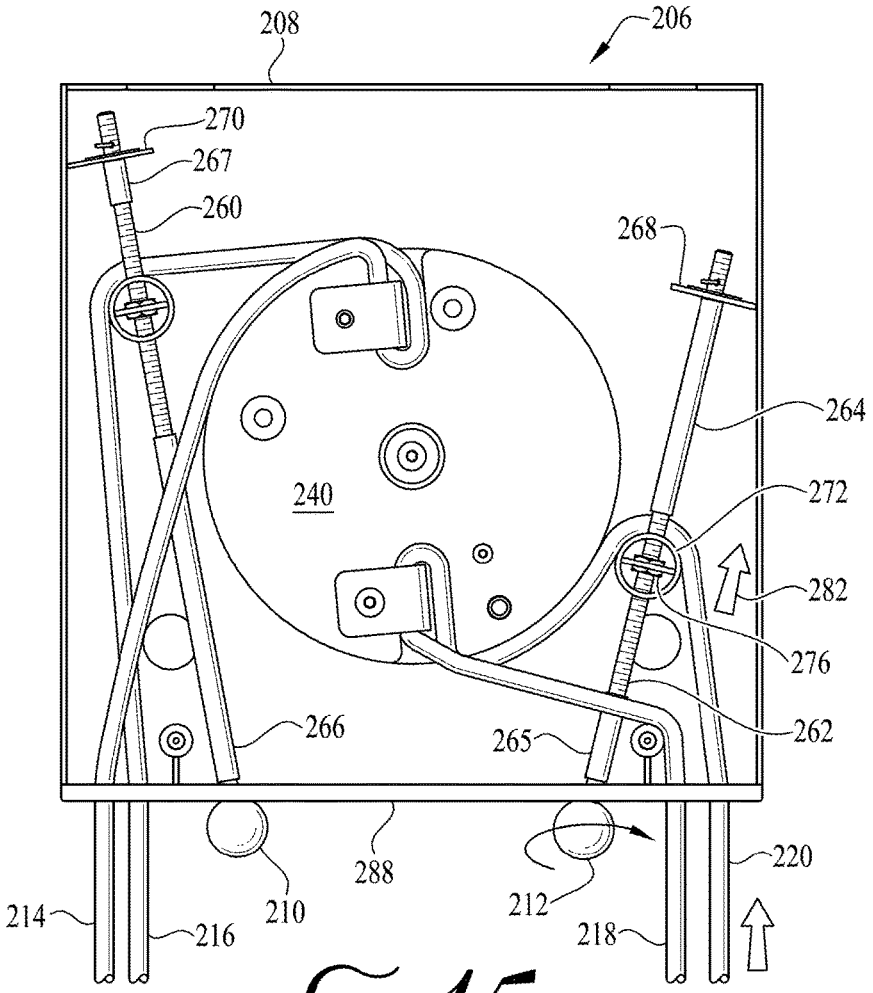
FIG. 15 is a plan view of the internal mechanism of the rope adjustment system of FIG. 12, showing the fine adjustment of one rope.

Referring now to FIGS. 13, 14, and 15, the rope adjustment assembly 206 is shown separate from the carriage assembly 34. There are two types of rope adjustment provided by the present rope adjustment assembly 206, a coarse rope length adjustment and a fine rope length adjustment. Looking first at the coarse rope length adjustment provided by the adjustment wheel 240 (described partly above as being fastened to the rotation bracket 222 of the handle assembly 209 so that both rotate together), one or more of the ropes 214, 216, 218, 220 (in this illustrated example all the ropes) are configured to wrap about or unwrap from, at least partially, the adjustment wheel 240 when the handle assembly 209 is rotated. Looking back at FIGS. 11 and 12, the handle assembly 209 is shown being rotated counterclockwise (an exemplary direction, from the reader's point of view) to cause the adjustment wheel 240 to rotate about the same rotation angle (being illustrated as clockwise in FIGS. 11 and 12) and wrap the ropes 214, 216, 218, 220 about the rope adjustment wheel 240 to cause all the ropes 214, 216, 218, 220 to shorten. In other words, the rope length available (e.g., the usable length or the free length) to the exerciser is reduced as the ropes are reeled about the rope adjustment wheel 240. Oppositely, when the handle assembly 209 is rotated clockwise (as viewed from FIGS. 11 and 12), the ropes 214, 216, 218, 220 unwrap from the rope adjustment wheel 240 to lengthen the ropes 214, 216, 218, 220, which increases the rope length available to the exerciser. Of course, the direction of rotation (clockwise and counterclockwise) to wrap or unwrap the ropes 214, 216, 218, 220 is a design choice and may be reversed. Further, although all four ropes 214, 216, 218, 220 are shown as capable of wrapping about the adjustment wheel 240, a lesser number or greater number of ropes may be configured to wrap about the adjustment wheel 240. The usable length of all four ropes 214, 216, 218, 220 are lengthened and shortened simultaneously, as the rotation of the rope adjustment wheel 240 changes all rope 214, 216, 218, 220 lengths equally and at the same time. The ropes 214, 216, 218, 220 may be attached to the rope adjustment wheel 240 in a variety of ways. In the illustrated example, the rope adjustment wheel 240 includes rope mount cutouts 248, 250, which are open ended grooves or other similar features which position the ropes 214, 216, 218, 220 to wrap about outer diameter 255 of the rope adjustment wheel 240. Rope clamps 252, 254 securely hold the ropes 214, 216, 218, 220 within the rope mount cutouts 248, 250, so that the ropes 214, 216, 218, 220 cannot be pulled free from the rope mount cutouts 248, 250 under normal usage. The ropes 214, 216, 218, 220 are illustrated in the example of FIGS. 13-15 as being two ropes which are folded within the rope mount cutouts 248, 250 to create two ropes apparently extending from the rope adjustment wheel 240, which permits the L-shaped or 90 degree rope clamps 252, 254 to more easily hold the folded rope, as the ropes fold about a leg of the rope clamps 252, 254 that extends down into the rope mount cutouts 248, 250. However, each rope 214, 216, 218, 220 may be separate from the others in design alternatives. By the exerciser grasping the handle 228 and rotating or shifting the handle assembly 209, the length of all of the ropes can be shortened or lengthened according to the needs of that exerciser.

Referring still to FIGS. 13-15, the rope adjustment wheel 240 rotates about the pivot center 258, which includes a fastener (e.g., a bolt, threaded stud, etc.) that connects the pivot center 258 to the spring pivot assembly 256.

FIGS. 13-15 additionally illustrate the fine rope length adjustment feature, which is controlled by the manual rotation of the first adjustment knob 210 and the second adjustment knob 212 extending from the front plate 288 of the enclosure 208. Fine rope length adjustment is provided by threaded shafts 260, 262 with the adjustment knobs 210, 212, respectively, attached to the ends of the threaded shafts 260, 262. The opposite ends of the threaded shafts 260, 262 are supported by shaft mounts 268, 270, which are plates welded to the enclosure 208, with female threads for receiving the male threads of the threaded shafts 260, 262. The ends of the threaded shafts 260, 262 nearest the adjustment knobs 210, 212 can be simply supported by the clearance holes in the front plate 288 through which the threaded shafts 260, 262 pass. On each threaded shaft 260, 262 there are two spacers or sleeves slipped or threaded over the threaded shafts 260, 262. A spacer 264, 267 is positioned over the threaded shafts 260, 262, respectively, nearest to the shaft mounts 268, 270. A spacer 265, 266 is positioned over the threaded shafts 260, 262, respectively, nearest to the adjustment knobs 210, 212. At least one purpose of the spacers 264, 265, 266, 267 is to limit the travel of the rope guide tubes 272, 274, through which the threaded shafts 260, 262 pass perpendicular to the central axis of the rope guide tubes 272, 274, where the rope guide tubes 272, 274 each include a threaded nut 276, 278 for receiving the threaded shafts 260, 262 threaded therethrough.

As the exerciser turns the adjustment knobs 210, 212 the rope guide tubes 272, 274 are permitted to travel along the length of the threaded shafts 260, 262 between the spacers 264, 265, 266, 267 (where the rope guide tubes 272, 274 move relative to the enclosure 208), and are thus limited by the spacers 264, 265, 266, 267. During operation, at least two of the ropes 214, 216, 218, 220 are bent about the rope guide tubes 272, 274, where, as the rope guide tubes 272, 274 travel toward the shaft mounts 268, 270, the length of the ropes (in this example, ropes 216, and 220) are shorted, each independent of the other. As the rope guide tubes 272, 274 travel toward the front plate 288, the length of the ropes 216, 220 are shortened, again, each independent of the other. In this way, when one rope becomes slightly longer or shorter than the other (for example, when the handles at the free ends of the ropes do not perfectly align due to the ropes stretching over time), the exerciser can finely adjust the length (from a small fraction of an inch to, perhaps, over several inches) of one or both ropes by turning the associated adjustment knob 210 or 212, until the rope lengths match.

Figure 16:
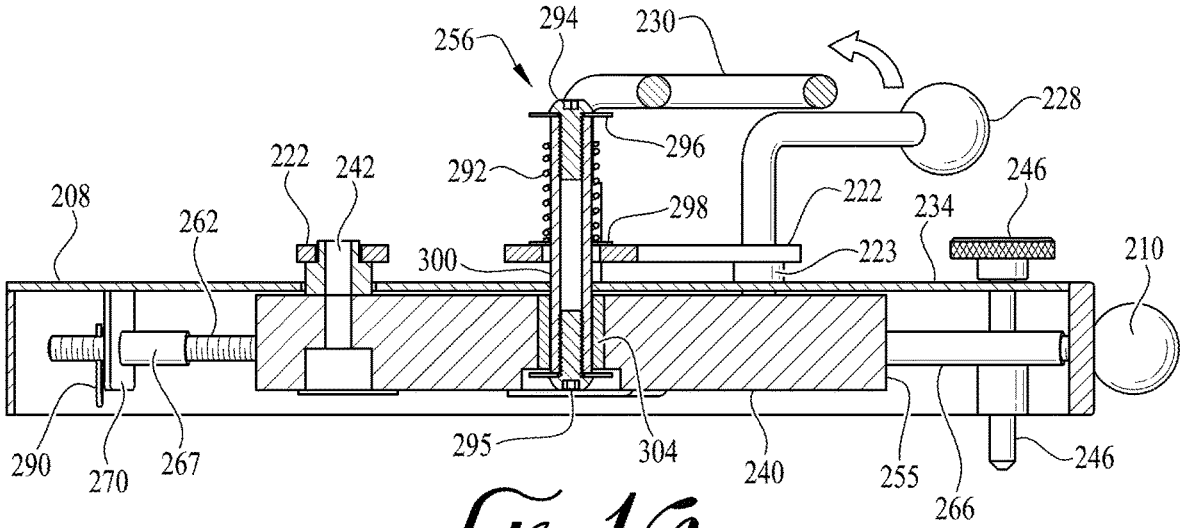
FIG. 16 is a cross-sectional view of the internal mechanism of the rope adjustment system of FIG. 12, showing the components of the spring pivot assembly.

FIG. 16 shows a cross-section of the present rope adjustment assembly 206, for more clearly illustrating construction and operation of the spring pivot assembly 256. The rotation bracket 222 is attached by welding to a pivot shaft 300, which extends through a center hole of the rope adjustment wheel 240, lined with a bushing 304 so that the rope adjustment wheel 240 can rotate about the pivot shaft 300. A screw 295 (with washer) captures the rope adjustment wheel 240 to the pivot shaft 300, yet still permits rotation of the rope adjustment wheel 240 relative to the pivot shaft 300. A compression coil spring 292 is slid over the pivot shaft 300 above the rotation bracket 222, with a screw 294 (with washer) capturing the spring 292 on the pivot shaft 300 between the screw 294 and the rotation bracket 222. In this way, when the exerciser pulls up on the handle 228, the spring 292 is compressed between the screw 294 (pressing against the washer) and the rotation bracket 222 to bias the rotation bracket 222 and the attached handle 228 back toward the bottom plate 234 of the enclosure 208, causing the pin 223 to be similarly biased to locate within one of the location holes 224, 225, 226, 227. In this view, the actual pin 223 is hidden from view by a spacer overtop the pin, where the spacer keeps the rotation bracket 222 separated from the bottom plate 234. A cotter pin 290 can be inserted overtop or through the threaded shafts 260, 262, acting as a limiter to prevent withdrawal of the threaded shafts 260, 262 from the shaft mounts 268, 270.

Figure 19:
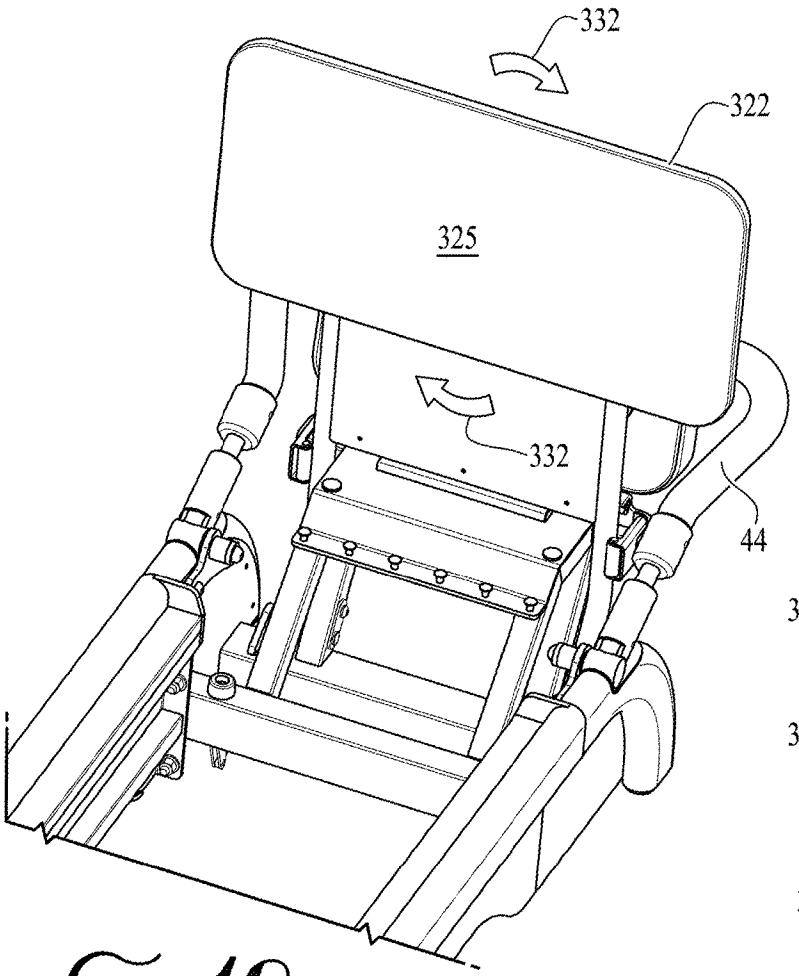
FIG. 19 is a top-back perspective partial view of the exercise device of FIG. 17, showing the jump board assembly tilted up and the jump board deployed by a clockwise rotation.

Turning now to FIGS. 17-20, the jump board assembly 315 is shown transitioning from the stowed configuration in FIG. 17 to the deployed configuration in FIGS. 19 and 20. In FIG. 17, the jump board assembly 315 is folded within the frame assembly 32 of the exercise device 30. Specifically, when in the stowed configuration, the jump board assembly 315 is folded between the frame rails 40, 42 and lower than the frame rails 40, 42. The jump board assembly 315 is sufficiently lower than the frame rails 40, 42 to provide clearance for the normal operation of the carriage assembly 34 as it rolls along the frame rails 40, 42, and for the normal operation of the rope adjustment assembly 206, as well as the springs and other components that operate beneath the carriage assembly 34. The jump board frame 316 is generally a U-shaped tubular steel structure, that rotates about both distal ends at hinges 323. A jump board 322 is rotatably mounted to the jump board frame 316 through the frame board 318. The hinges 323 permit the carriage assembly 34 to transition from the jump board 322 being substantially parallel with the frame rails 40, 42 and carriage 62 (or with 0-10 or 10-20 degrees of parallel) to the jump board 322 being substantially planar perpendicular with the frame rails 40, 42 and carriage 62 (or with 0-10 or 10-20 degrees of parallel).

The jump board 322 includes a frame board 318 attached firmly to the frame 316, where the frame board 318 is made of a sheet of material such as a plywood, oriented strand board, medium density fiber board, etc. Attached to the frame board 318 (or, optionally, the frame 316) are ring mounts 49 holding a resistance ring 48, which is securely attached to the frame board 318 so that the jump board assembly 315 can stowed or deployed with the jump board 322, yet removed at any time for exercises with the resistance ring 48. The frame board 318 further includes a pull pin 314 (which is used to rotate the jump board 322, as discussed below) and a pivot 330 that rotatably connects the jump board 322 to the frame board 318. The jump board 322 includes a handle 320 mounted to the back board 324 for lifting the jump board 322 and a rotation locking plate 334.

FIG. 18 shows the jump board assembly 315 during the process of deployment, where the footbar 44 is tilted down, as indicated by arrow 315, and front platform 46 is tilted up, to provide clearance for the jump board frame 316 and jump board 322. With the jump board assembly 315 tilted up, as indicated by arrow 328, one of the bumpers 326 mounted to the frame cross member can be seen. An additional bumper (no visible) can be positioned on the opposite side of the frame cross member. These bumpers 326 are designed to prevent metal-to-metal contact between the jump board frame 316 and to quiet the operation of the jump board assembly 315. When the jump board assembly 315 is tilted up vertically, roller catches 327 are mounted on each side of the front platform 46, and are configured to deflect outwardly against an inward spring bias when the frame 316 rotates up and pushes the roller catches 327 outwardly. Once past the rollers of the roller catches 327, the frame 316 is selectively held by the roller catches 327, until sufficient force is applied to the frame 316 to overcome the spring bias in the roller catches 327, so that the jump board assembly 315 can be once again stowed.

The rotation of the jump board 322, as indicated by arrows 332 in FIG. 19, permit the jump board 322 portion of the jump board assembly 315 to rotate ninety degrees to the fully deployed configuration. Since the jump board 322 is rectangular, the width of the jump board 322 has a dimension sufficiently narrow to fit between the frame rails 40, 42. However, if the jump board 322 were to be simply tilted up, it would be undesirable to exercise with longitudinal sides of the jump board 322 oriented vertically, as shown in FIG. 18, the jump board 322 would be too narrow for many exercises (although, it is still possible to exercise in this orientation—just undesirable). Thus, the ability of the jump board 322 to rotate so that the longitudinal sides are parallel to the floor (or other horizontal support surface), enables the compact storage of the jump board 322 when stowed and the full surface of the jump board 322 being available to the exerciser when deployed, as the exerciser needs the jump board 322 as oriented as in FIGS. 19 and 20 to provide a wide surface upon which to kick off of with both feet.

The rotation lock mechanism 333 permits the locking of the orientation of the jump board 322 relative to the frame 316. The frame board 318 is attached to the frame 316, with the jump board 322 rotating on the frame board 318 about pivot 330 (a threaded shaft with a bushing or the like). A rotation locking plate 334 is attached to the back side of the jump board 322. The rotation locking plate 334 supports the mating side of the pivot 330, and includes a pull pin 314 positioned a distance apart from the pivot 330, where the pull pin 314 selectively locks the orientation of the jump board 322 relative to the frame board 318. The rotation locking plate 334 further includes an arced slot 336 that receives a guide pin 338 extending from the frame board 318, for limiting the rotation of the jump board 322 to a predetermined angle, ninety degrees in this example. The pull pin 314 is mounted on the frame board 318, where its pin inserts into one of two holes in the jump board 322 (one at zero and the other at ninety degrees, with more holes available in alternate embodiments). In use, the exerciser pulls on the pull pin 314 to retract its pin from the mating hole, rotates the jump board 322 ninety degrees, where the pin of the pull pin 314 will drop into the other hole. The handle 320 can be used to stow, deploy, and rotate the jump board 322. Returning the jump board assembly 315 to the stowed configuration is a simple matter of reversing the above-described steps.

FIGS. 21-26 illustrate an example embodiment of a platform catch assembly 382, which selectively holds the front platform 46 in an upright (e.g., a substantially vertically oriented position, within 10 degrees or within 20 degrees from vertical) and in a flat position (e.g., a substantially horizontally oriented position, within 5 degrees or within 10 degrees from horizontal). When using the front platform 46, the exerciser often stands on various areas of the top surface of the front platform 46. To prevent accidental tilting of the front platform 46 while standing near the front edge 416, the platform catch assembly 382 is configured to resist unintended tilting. Moreover, the platform catch assembly 382 prevents the front platform 46 from slamming shut when upright.

The platform catch assembly 382 generally comprises a hinge 388 positioned at or near the structural front edge 416 (e.g., within 0.5", or within 1", or within 2") of the front platform 46 to rotatably connect the front platform 46 to the support bracket 400 of the platform frame 408, thus, allowing the front platform 46 to pivot about the hinge 388 and rotate relative to the platform frame 408. The fabric covered cushioning may extend slightly beyond the base structure of the front platform 408, depending on the density and structural qualities of the internal foam, etc., as it may not produce a torque about the hinge 388 substantial enough to tilt the front platform 46 when a weight is applied in this unsupported area. The front platform 46 is supported atop and fastened to a support plate 389, which, in turn, supports the hinge 388. The support plate 389 includes a tab acting as a catch plate 390 bent at a right angle (or other appropriate angle) to the front platform 46 and extending downward. Beneath the front platform 46 a roller bracket 386 supporting a roller 384. The roller bracket 386 is hinged to the platform frame 408 by the pivot 402 (e.g., a hinge). A compression spring 406 is captured between the roller bracket 386 and the platform frame 408 by a bolt 404 inserted through the spring 406 and fastened between the roller bracket 386 and the platform frame 408. This permits the roller 384 to be pushed down by the bottom edge 391 of the catch plate 390, as the front platform 46 is tilted about hinge 388, where the roller bracket 386 tilts about pivot 402 against the bias of the spring 406.

Figure 22:
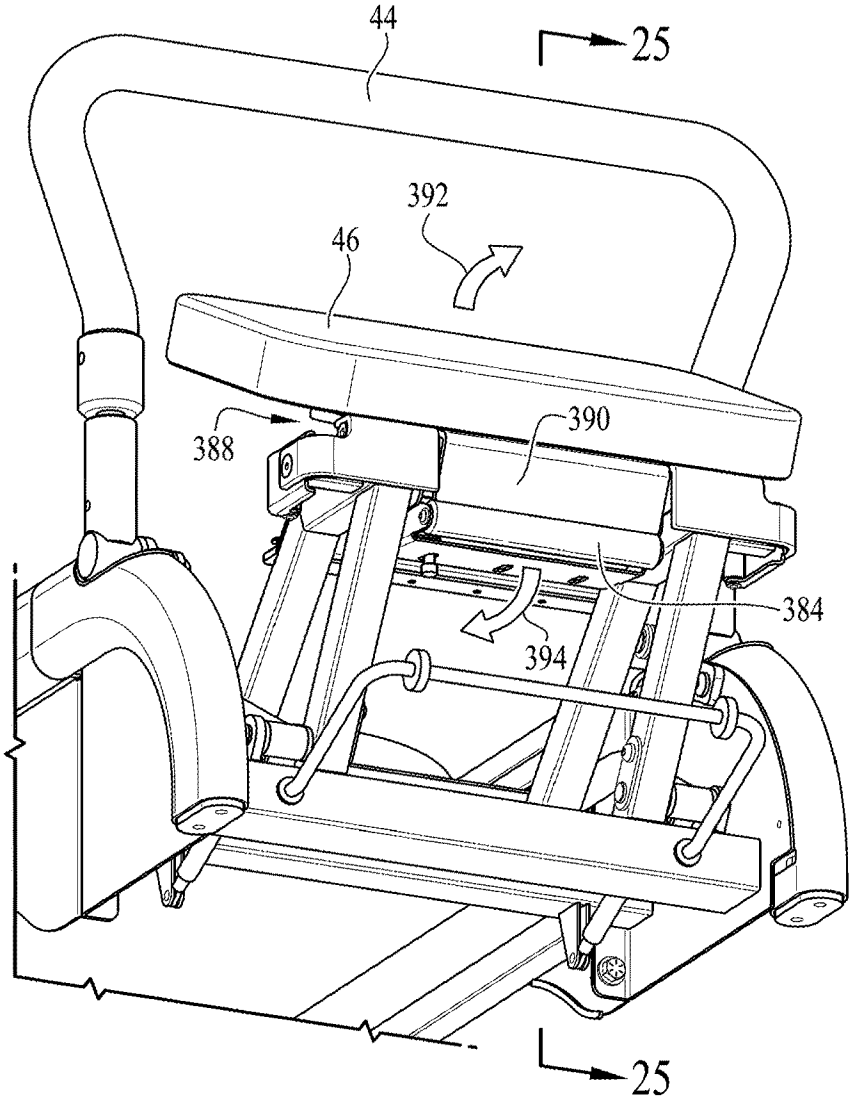
FIG. 22 is a bottom-front perspective partial view of the exercise device of FIG. 21, with the front platform in the midst of being tilted up.
Figure 21:
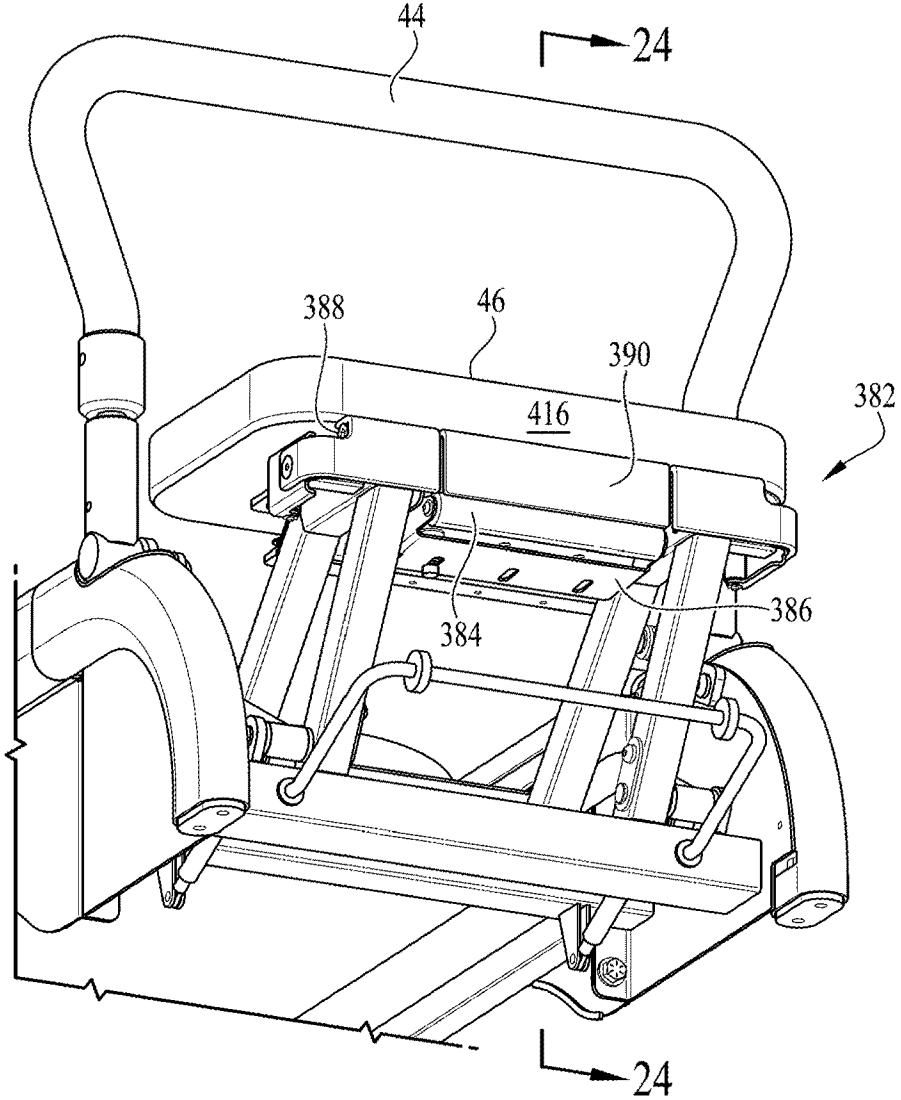
FIG. 21 is a bottom-front perspective partial view of the present exercise device, showing the front platform tilt mechanism with the front platform in the down position.
Figure 23:
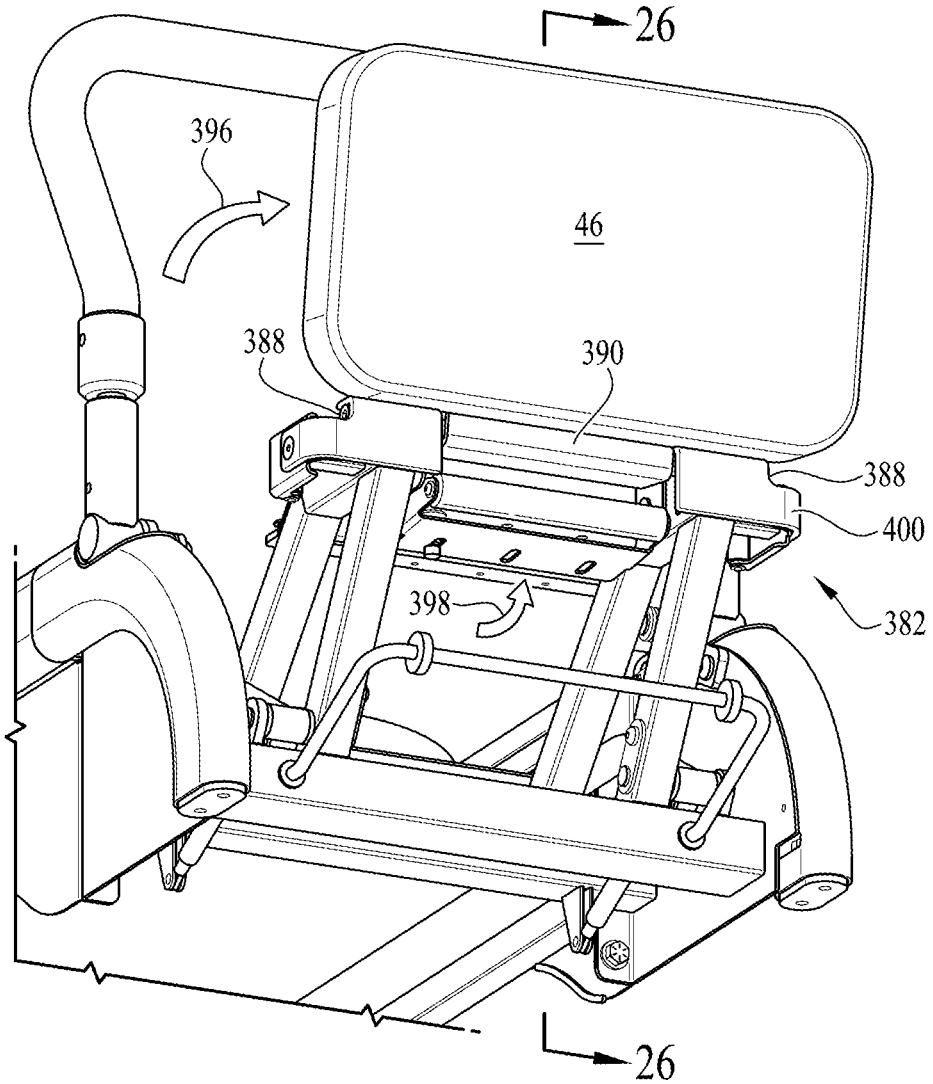
FIG. 23 is a bottom-front perspective partial view of the exercise device of FIG. 21, with the front platform in the tilted up position.
Figure 24:
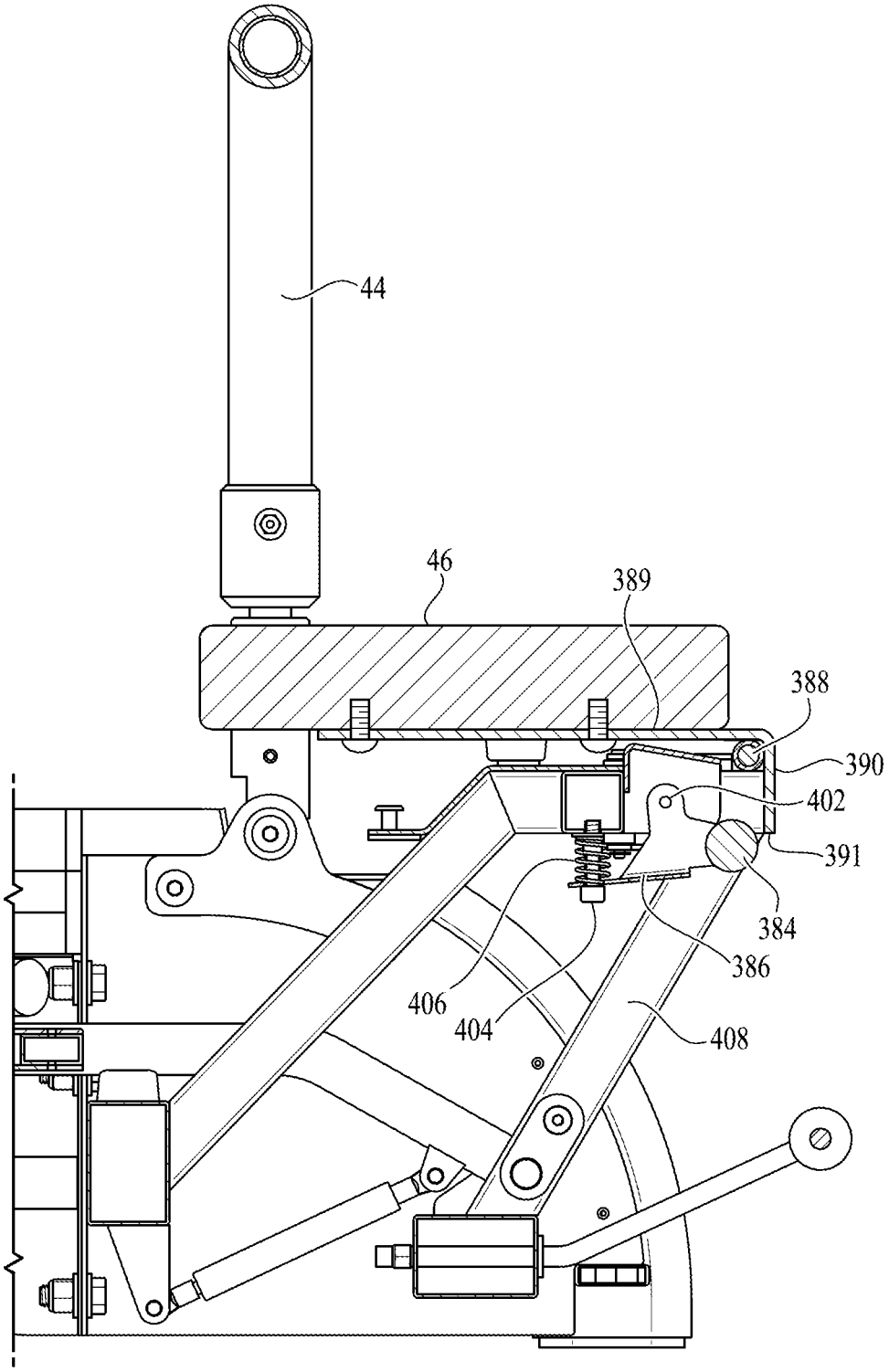
FIG. 24 is a cross-sectional view of the internal mechanism of the front platform tilt mechanism of FIG. 21, showing the front platform in the down position.
Figure 25:
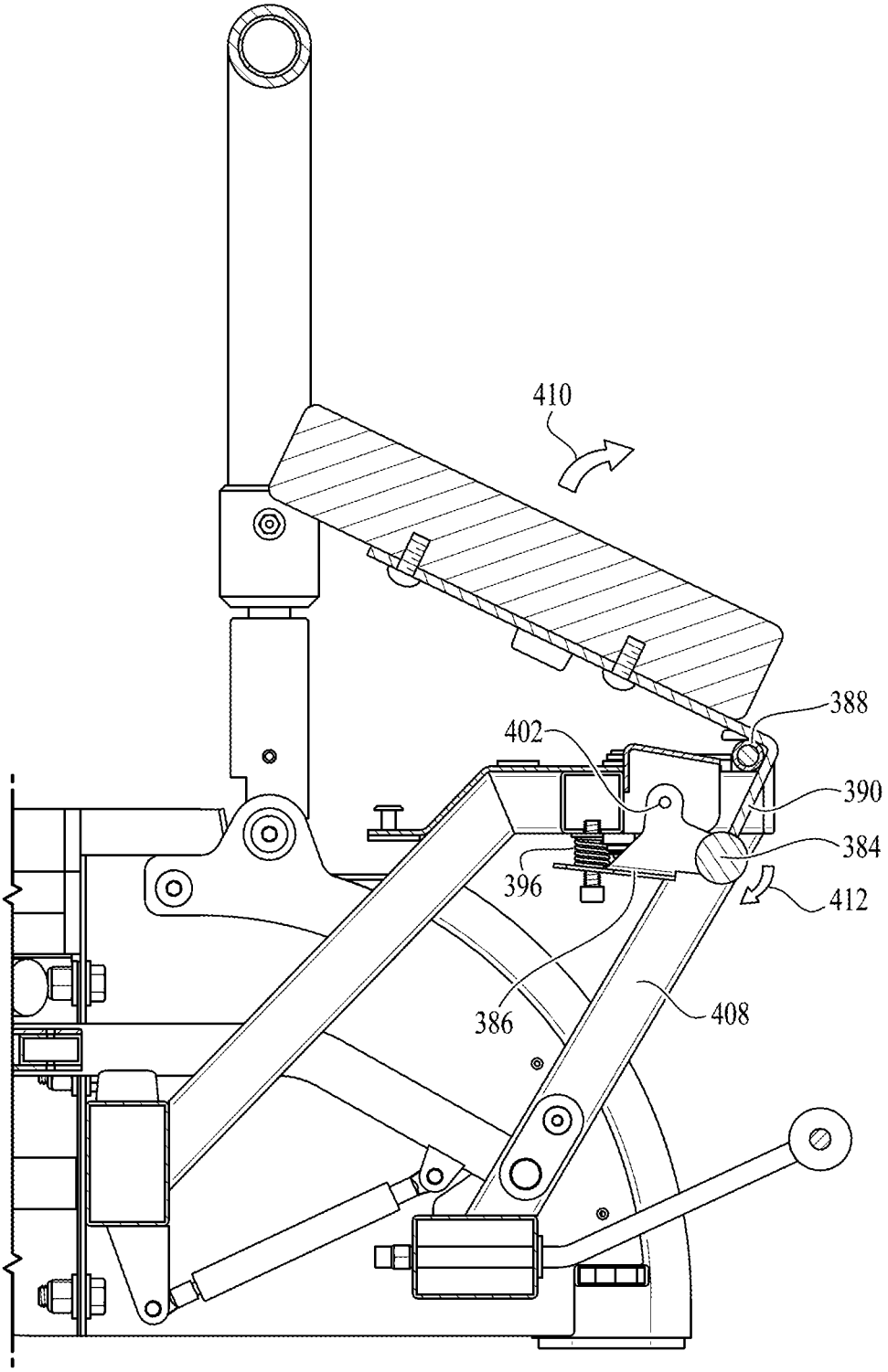
FIG. 25 is a cross-sectional view of the internal mechanism of the front platform tilt mechanism of FIG. 21, showing the front platform in the midst of being tilted up.
Figure 26:
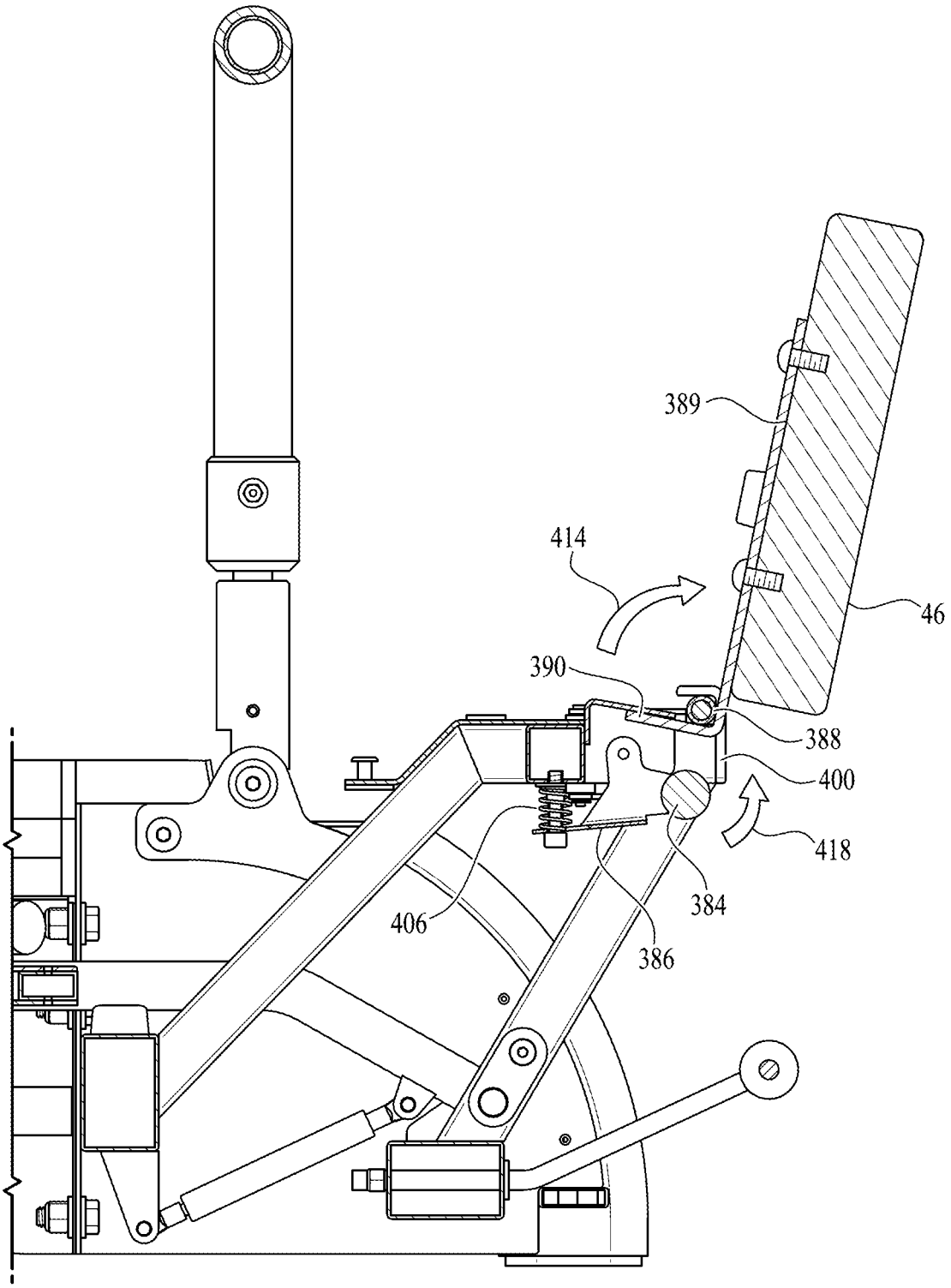
FIG. 26 is a cross-sectional view of the internal mechanism of the front platform tilt mechanism of FIG. 21, showing the front platform in the tilted up position.

Looking at the operation of the platform catch assembly 382, the front platform 46 in related FIGS. 21 and 24, is shown in the horizontally oriented configuration, where the exerciser can use the front platform 46 in various exercises (i.e., the front platform 46 is in an active configuration). It can be seen that the roller 384 and roller bracket 386 are beneath the front platform 46 and do not provide any direct spring bias against the catch plate 390. Related FIGS. 22 and 25 show the front platform 46 in the process of being tilted up about hinge 388, as indicated by arrows 392 and 410. Arrows 394 and 412 illustrate that the roller bracket 386 with the roller 384 are being pushed (tilted) downward by the bottom edge 391 of the catch plate 390 acting directly on the roller 384. The roller 384 is free to roll on the roller bracket 386, and is made of a tough polymer material, such as DELRIN or the like, to resist wear and provide quiet operation. FIG. 25 shows that, as the catch plate 390 pushes on the roller 384, the spring 406 on the opposite side of the pivot 402 is compressed. Finally, looking at related FIGS. 23 and 26, the front platform 46 is shown in the vertically oriented configuration, where the front platform 46 is in an inactive configuration, providing clearance for other exercises or access to the various components therebelow, such as fastening or unfastening resistance springs. Although, the configuration is indicated as being vertical or vertically oriented, the hinge 388 permits the front platform 46 to rotate slightly past ninety degrees (e.g., five to fifteen degrees greater than ninety degrees) so that the front platform 46 will remain upright, with the catch plate 390 resting against a portion of the platform frame 408 (or connected part) to limit the rotation of the front platform 46. Once the catch plate 390 is pushed past the roller 384, the roller bracket 386 and roller 384 are pushed back up (toward the hinge 388) by the spring 406. Once the front platform 46 has been tilted up, as indicated by arrows 396 and 414, the roller bracket 386 is permitted to rotate, as indicated by arrow 418, so that the roller 384 returns to its original position, where it does not exert a force on the catch plate 390.

Figure 29:
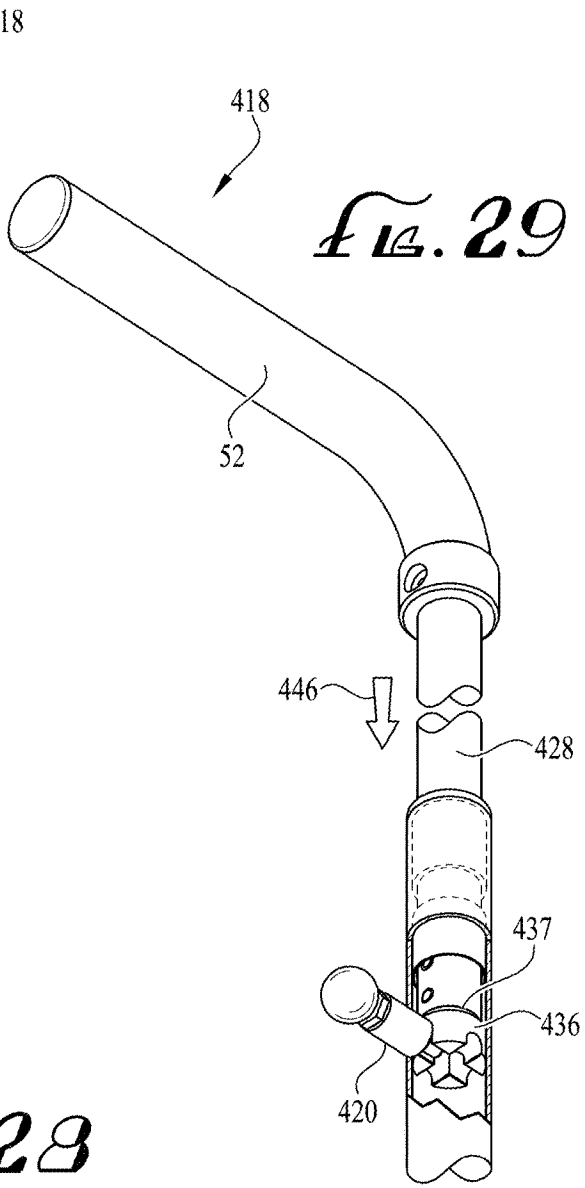
FIG. 29 is a partial perspective view, with partial broken-out section view, showing the handle bar adjustment assembly of FIG. 27 with the handle bar lowered to lock into the new angular position.
Figure 28:
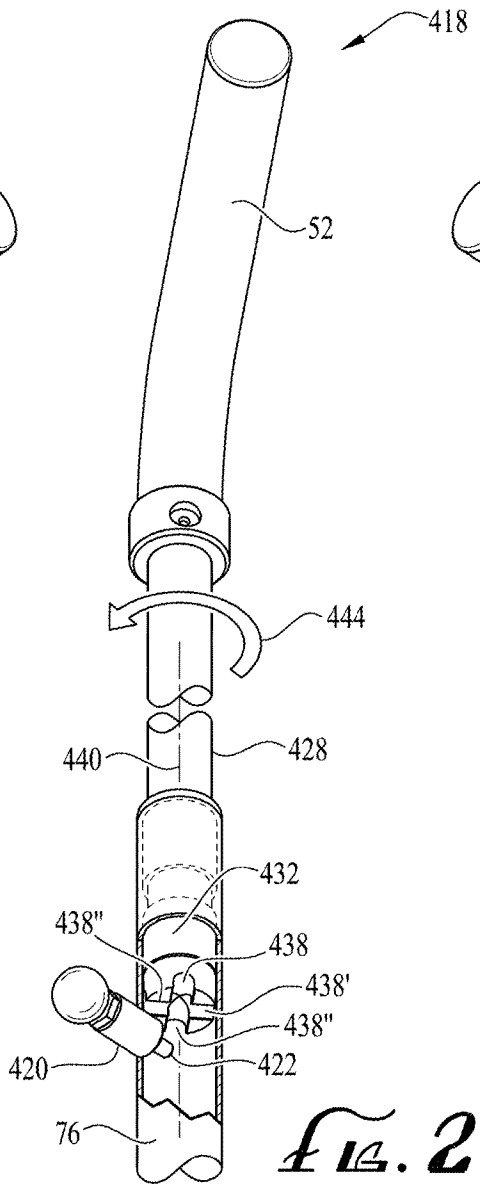
FIG. 28 is a partial perspective view, with partial broken-out section view, showing the handle bar adjustment assembly of FIG. 27 with the handle bar being rotated.
Figure 27:
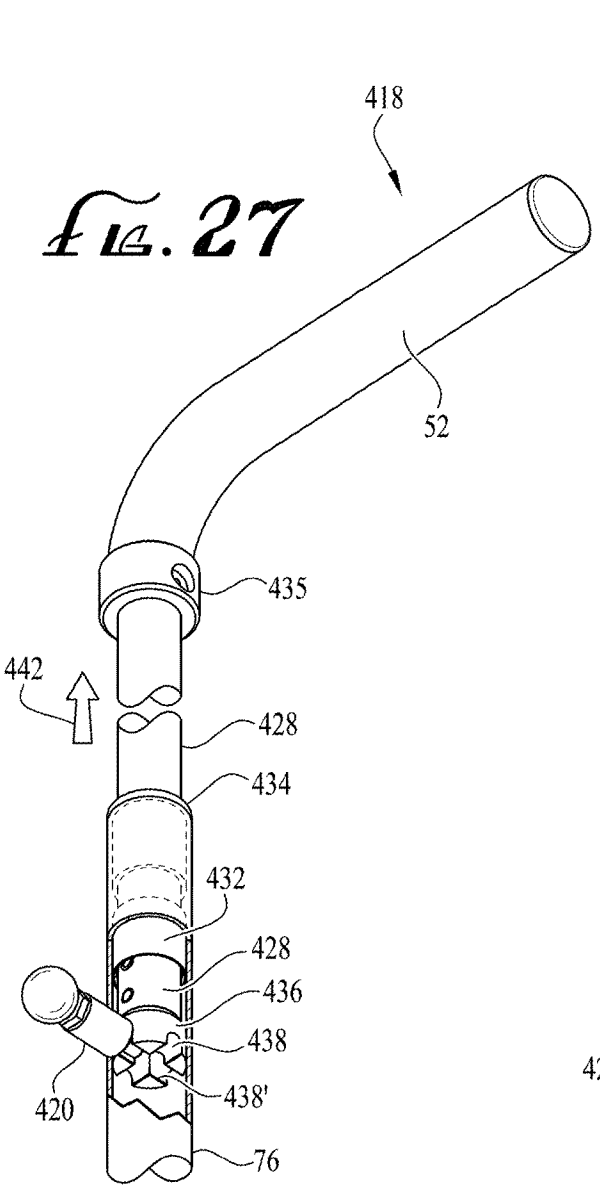
FIG. 27 is a partial perspective view, with partial broken-out section view, showing the handle bar adjustment assembly in isolation, with the handle lifted and ready for rotation to a new angular position.

In FIGS. 27-29, the adjustable handle assembly 418 is shown in the process of being adjusted by turning the handle 52 and handle bar 428 about the longitudinal axis 440 of the handle bar 428, to change the orientation of the handle 52 relative to the remainder of the exercise machine 30. For example, the handle 52 may be oriented parallel or perpendicular to the side rail 42, pointed to either lateral side or forward or back. Thus, in the illustrated example embodiment, the handle can be oriented and locked in one of four directions angularly spaced ninety degrees apart.

Looking first at FIG. 27, the handle 52 and handle bar 428 are connected or are constructed of a single bent bar or tube, with the handle 52 formed by the ninety degree bend in the bar. A foam cover or other cushioning can be slid over the bar of the handle 52. A vertical portion of the handle bar 428 is telescopically inserted into the handle bar post 76, and is permitted to rotate and slide axially within the handle bar post 76, as both the handle bar post 76 handle bar 428 have a circular cross-section. The end of the handle bar 428 is positioned within the handle bar post 76, with an end piece 436 attached (or formed on) to the end of the handle bar 428. The end piece 436 is generally larger in diameter than the handle bar 428, which creates a shoulder 437 that protrudes above the outer surface of the handle bar 428. A plurality of pin receivers 438, 438', 438', 438''' are formed on the distal end of the end piece 436, In this example embodiment, the pin receivers 438, 438', 438', 438''' is comprised of two intersecting grooves formed on the distal end of the end piece 436. Alternatively, there may be other structures that perform a similar function, such as a plurality of notches or the like formed in a radial pattern on the distal end of the end piece 436. The pin receivers 438, 438', 438', 438''' are configured to each selectively receive the pin 422 of the pull pin 420. Because the pin receivers 438, 438', 438', 438''' are formed by two grooves intersecting at ninety degrees, movement of the handle bar 428 from one pin receiver to the adjacent pin receiver moves the handle bar 428 angularly by ninety degrees.

Still looking at FIG. 27, the handle 52 and handle bar 428 are shown raised configuration (versus the lowered configuration shown in FIG. 1, with the handle 52 in its lowest position, where the collar 435 is adjacent to or touching the busing 434 capping the opening of the handle bar post 76) and in a first position where the handle bar 428 is oriented to position the pin 422 within pin receiver 438". To change angular position, the handle bar 428 is lifted upwards, as indicated by arrow 442, to lift the pin receiver 438" above the pin 422. To prevent the withdrawal of the handle bar 428 from the handle bar post 76, a stop 432 is positioned or formed on the inner diameter of the handle bar post 76. In this example, the stop 432 is a sleeve that is fastened or spot welded to the inner diameter of the handle bar post 76. The sleeve provides clearance so that the handle bar 428 can freely move up and down, yet provides a stop to prevent the handle bar 428 from being removed from the handle bar post 76 during adjustment. As the handle bar 428 is lifted, the shoulder 437 of the end piece 436 contacts the stop 432. Since the diameter of the shoulder 437 is larger than the inner diameter of the stop 432 (e.g., the sleeve), the stop 432 does not permit the handle bar 428 to be lifted further. Although the stop 432 is shown as a sleeve, there are many operable configurations, such as a protrusion created by stamping a dimple on the handle bar post 76 which protrudes into the inner diameter or other known technique to restrict the inner diameter of the handle bar post 76.

Turning now to FIG. 28, the handle 52 can be seen being turned from the right to the left, as indicated by arrow 444. The exerciser simply turns the handle 52 until the desired angular orientation is reached, and the pin receiver aligned with the pin 422 receives the pin 422 and locks the angular position. In this example, referring also to FIG. 29, the handle 52 is rotated ninety degrees to reposition the handle bar 428 from pin receiver 438" to pin receiver 438. Once aligned with pin receiver 438, the handle bar 428 drops down, as indicated by arrow 446, to position the pin receiver 438 top the pin 422; thus, locking the handle 52 and handle bar 428 in a new angular position.

The exerciser can move the handle bar 428 from the raised position to the lowered position (i.e., changing the height of the handles 52) by pulling the pull pin 420 to retract the pin 422, providing clearance for the end piece 436 to pass the pin 422 and drop to the bottom 426 of the handle bar post 76, where one or more of the pin receivers 438, 438', 438', 438''' engages the lower pin 424 to similarly lock the angular position of the handle bar 428 in ninety degree increments (see also FIG. 1). The lower pin 424 generally is secured to the bottom 426 of the handle bar post 76, spanning the inner diameter. In a manner very similar to the upper pin 422, the angular position of the handle 52 can be changed by lifting the handle 52 and repositioning the handle bar 428 until the lower pin 424 is engaged within one or more pin receivers 438, 438', 438', 438".

The shoulder 437 includes a chamfered upper edge for permitting the handle bar 428 to transition from the lowered position to the raised position without manually pulling on the pull pin 420. As the handle bar 428 is pulled up, the chamfered upper edge of the shoulder 437 of the end piece 436 strikes the pin 422 of the pull pin 420, where the chamfered edge (or other slanted or rounded edge) pushes against the pin 422, pushing the pin 422 into the pull pin 420 assembly, permitting the end piece 436 to pass the pin 422.

As soon as the end piece 436 passes the pin 422, the spring loaded pin 422 immediately extends back into the interior of the handle bar post 76 to block the downward movement of the handle bar 428. In this way, the exerciser can quickly transition and lock the handle 52 from the lowered position to the raised position, without having to operate the pull pin 420.

Figure 30:
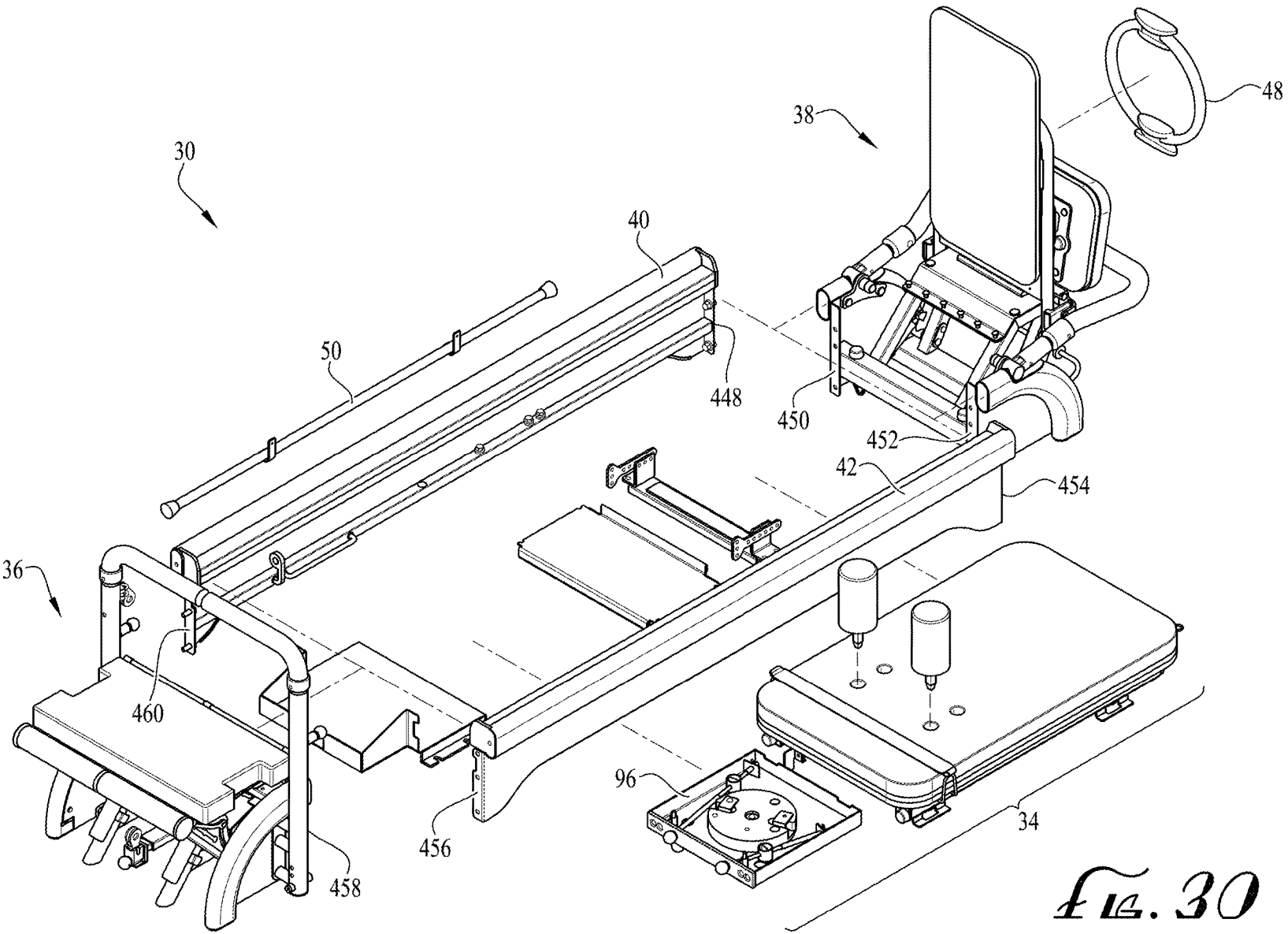
FIG. 30 is a perspective exploded view of the present exercise device, showing the major components separated and ready for individual or bundled shipment in small parcels.

Often it is difficult for exercise studio staff and delivery staff to bring fully assembled exercise machines into a studio, as the assembled machine is heavy, bulky, long, and generally difficult to manipulate through tight corners and through stairs, etc. Yet, a disassembled machine is equally difficult for staff to assemble in place, as there are numerous parts and tight tolerances. FIG. 30 (and also referencing FIG. 4) illustrates a novel means to easily ship and carry the present exercise device 30, and easily assemble it at the studio. As discussed above, the exercise machine 30 is divided into assemblies (or sub-assemblies), primarily comprising the front end assembly 38, the back end assembly 36, the carriage assembly 34 (which can, optionally, include the rope length adjustment assembly 96. The side rails 40, 42 and other miscellaneous parts can be packaged together or in separate boxes, as packaging requirements dictate. The mating faces 448, 450, 452, 454, 456, 458, 460 (and one hidden face) of the separate assemblies create a point where two mating assemblies can be fastened together easily, For example, mating face 450 of the front end assembly 38 is brought into alignment with the mating face 448 of the side rail 40. As seen in FIG. 4, fasteners 106 (three nut and bolt pairs in this example) can be tightened to a specified torque to fasten the front end assembly 38 to the side rail 40, to create joint 104. All the mating surfaces are similarly fastened to create the fully assembled exercise device 30.

What is claimed is:

1. An exercise machine comprising:

a purchase configured to be moved by application of an exerciser force;

a resistance source providing a resistance force;

a resistance adjuster configured to be selectively moved relative to the purchase to change a magnitude of the resistance force transmitted to the purchase;

a linkage providing a connection between the resistance source and the resistance adjuster and selectively transmitting the resistance force;

a strain relief coupled to the linkage and operably positioned between the resistance source and the resistance adjuster, when engaged the strain relief selectively reduces the resistance force transmitted through the linkage to the resistance adjuster to permit movement of the resistance adjuster relative to the purchase, when disengaged the strain relief permits transmission of the resistance force through the linkage to the resistance adjuster; and a frame, wherein the purchase is a pedal, the pedal is positioned at a distal end of a pedal arm, the pedal arm hinged to the frame at a proximal end thereof to the frame, wherein the resistance adjuster comprises a slot with a plurality of enlarged portions and a pull pin coupled with the linkage, wherein the pull pin is selectively permitted to slide within the slot manually and selectively lock in position along the slot within one of the plurality of enlarged portions when released, and wherein the slot is formed within a plate positioned on the pedal arm, the plate further comprising an arced slot, a linkage bar comprising first and second ends, the linkage bar carrying the pull pin at the first end and carrying a pin at the second end, the pin configured to slide within the arced slot as the pull pin is slid within the slot, the linkage being connected to the pin.

2. The exercise machine of claim 1 wherein the linkage is a cable and the strain relief comprises a stop fixed to the cable, the stop being configured to bear against a portion of the frame when engaged such that the portion of the frame bears the resistance force sufficiently to permit movement of the resistance adjuster relative to the purchase.

3. The exercise machine of claim 1 wherein the strain relief comprises a stop fixed to the linkage, the stop being configured to bear against a portion of the frame of the exercise machine when engaged such that the portion of the frame bears the resistance force sufficiently to permit movement of the resistance adjuster relative to the purchase.

4. The exercise machine of claim 3 wherein the stop moves with a travel of the linkage as the purchase is moved in a direction away from the portion of the frame.

5. The exercise machine of claim 4 wherein the linkage is a cable and the portion of the frame is a plate with an opening through which the cable travels, the opening being sized to prohibit passage of the stop therethrough, and wherein the stop is configured to relieve a cable tension when engaged in a portion of the cable between the stop and the resistance adjuster.

6. An exercise machine comprising:

a purchase configured to be moved by application of an exerciser force;

a resistance source providing a resistance force;

a resistance adjuster configured to be selectively moved relative to the purchase to change a magnitude of the resistance force transmitted to the purchase, the resistance adjuster comprising a slot with a plurality of enlarged portions and a pull pin coupled with a linkage, the pull pin is selectively permitted to slide within the slot manually and selectively lock in position along the slot within one of the plurality of enlarged portions;

the linkage providing a connection between the resistance source and the resistance adjuster and selectively transmitting the resistance force; and a strain relief coupled to the linkage and operably positioned between the resistance source and the resistance adjuster, when engaged the strain relief selectively reduces the resistance force transmitted through the linkage to the resistance adjuster to permit movement of the resistance adjuster relative to the purchase, when disengaged the strain relief permits transmission of the resistance force through the linkage to the resistance adjuster, wherein the slot is formed within a plate positioned on the pedal arm, the plate further comprising an arced slot, a linkage bar comprising first and second ends, the linkage bar carrying the pull pin at the first end and carrying a pin at the second end, the pin configured to slide within the arced slot as the pull pin is slid within the slot, the linkage being connected to the pin.

7. The exercise machine of claim 6 wherein the purchase is a pedal, the pedal arm hinged at a proximal end thereof to a frame.

8. The exercise machine of claim 6 wherein the linkage is a cable and the strain relief comprises a stop fixed to the cable, the stop being configured to bear against a portion of a frame when engaged such that the portion of the frame bears the resistance force sufficiently to permit movement of the resistance adjuster relative to the purchase.

9. The exercise machine of claim 6 wherein the strain relief comprises a stop fixed to the linkage, the stop being configured to bear against a portion of a frame of the exercise machine when engaged such that the portion of the frame bears the resistance force sufficiently to permit movement of the resistance adjuster relative to the purchase.

10. The exercise machine of claim 9 wherein the stop moves with a travel of the linkage as the purchase is moved in a direction away from the portion of the frame.

11. The exercise machine of claim 10 wherein the linkage is a cable and the portion of the frame is a plate with an opening through which the cable travels, the opening being sized to prohibit passage of the stop therethrough, and wherein the stop is configured to relieve a cable tension when engaged in a portion of the cable between the stop and the resistance adjuster.

* * * * *